US010457072B2

(12) United States Patent
Hirose et al.

(10) Patent No.: US 10,457,072 B2
(45) Date of Patent: Oct. 29, 2019

(54) PROCESSING OBJECT REFORMING APPARATUS, PRINTING APPARATUS, PROCESSING OBJECT REFORMING SYSTEM, PRINTING SYSTEM, AND MANUFACTURING METHOD OF PRINTED MATTER

(71) Applicants: Yohji Hirose, Ibaraki (JP); Junji Nakai, Kanagawa (JP); Kunihiro Yamanaka, Kanagawa (JP)

(72) Inventors: Yohji Hirose, Ibaraki (JP); Junji Nakai, Kanagawa (JP); Kunihiro Yamanaka, Kanagawa (JP)

(73) Assignee: Ricoh & Company, Ltd., Tokyo (JP)

( * ) Notice: Subject to any disclaimer, the term of this patent is extended or adjusted under 35 U.S.C. 154(b) by 737 days.

(21) Appl. No.: 14/657,922

(22) Filed: Mar. 13, 2015

(65) Prior Publication Data

US 2015/0266311 A1 Sep. 24, 2015

(30) Foreign Application Priority Data

Mar. 18, 2014 (JP) ..... 2014-055631
Nov. 21, 2014 (JP) ..... 2014-237011

(51) Int. Cl.
*H05B 1/02* (2006.01)
*B41J 11/00* (2006.01)

(52) U.S. Cl.
CPC ..... *B41J 11/0015* (2013.01)

(58) Field of Classification Search
CPC ..... B41J 11/0015; B41J 11/42; B41J 29/02; H05H 1/36; H05H 1/26
USPC ..... 219/121.43, 121.36, 121.54; 156/345.43, 156/345.38
See application file for complete search history.

(56) References Cited

U.S. PATENT DOCUMENTS 6,392,210 B1 * 5/2002 Jewett ..... H01J 37/32082 219/121.54
7,791,281 B2 * 9/2010 Aldea ..... H01J 37/32174 118/723 E
8,186,823 B2 * 5/2012 Saitoh ..... C09D 11/322 347/102
8,366,260 B2 * 2/2013 Gauss ..... B41J 3/407 347/101
9,225,299 B2 * 12/2015 Mueller ..... H02P 9/105
2007/0058019 A1 * 3/2007 Saitoh ..... B41J 11/002 347/101

(Continued)

FOREIGN PATENT DOCUMENTS

JP 2008016517 A 1/2008
JP 2009-279796 12/2009

(Continued)

OTHER PUBLICATIONS

Japanese office action; dated Sep. 25, 2018.

*Primary Examiner* — Mark H Paschall
(74) *Attorney, Agent, or Firm* — Duft & Bornsen, PC

(57) ABSTRACT

A processing object reforming apparatus includes a plasma processing unit that acidifies at least a surface of a processing object by processing the surface of the processing object by using plasma; and a control unit that controls the plasma processing unit to plasma-process the processing object with a plasma energy amount based on a type of the processing object.

20 Claims, 17 Drawing Sheets

(56) References Cited

U.S. PATENT DOCUMENTS

| | | | | |
|---|---|---|---|---|
| 2013/0258017 | A1* | 10/2013 | Kagose | B41M 7/0081 347/102 |
| 2014/0078212 | A1* | 3/2014 | Nakai | B41J 2/07 347/16 |
| 2014/0160197 | A1* | 6/2014 | Hirose | B41M 5/0011 347/16 |
| 2016/0207306 | A1* | 7/2016 | Landa | B41M 5/0256 |

FOREIGN PATENT DOCUMENTS

| | | |
|---|---|---|
| JP | 2010-188568 | 9/2010 |
| JP | 4662590 | 1/2011 |
| JP | 2013199017 A | 10/2013 |

* cited by examiner

FIG.16

| | | |
|---|---|---|
| RESOLUTION 600 dpi | SMALL DROPLET [pl] | 2.5 |
| | INTERMEDIATE DROPLET [pl] | 6.5 |
| | LARGE DROPLET [pl] | 15 |
| RESOLUTION 1200 dpi | SMALL DROPLET [pl] | 2 |
| | INTERMEDIATE DROPLET [pl] | 4 |
| | LARGE DROPLET [pl] | 6 |

FIG.17

| SIZE OF DROPLET [pl] | TYPE OF PAPER (PLASMA ENERGY [J/cm$^2$]) | | | | | | |
|---|---|---|---|---|---|---|---|
| | PLAIN PAPER A | PLAIN PAPER B | COATED PAPER A | COATED PAPER B | COATED PAPER C | FILM A | FILM B |
| 2 | 0.07 | 0.1 | 0.14 | 0.5 | 1 | 0.07 | 0.14 |
| 2.5 | 0.07 | 0.1 | 0.14 | 0.5 | 1 | 0.07 | 0.14 |
| 4 | 0.08 | 0.12 | 0.7 | 1.4 | 2.8 | 0.08 | 0.16 |
| 6 | 0.08 | 0.12 | 0.7 | 1.4 | 2.8 | 0.08 | 0.16 |
| 6.5 | 0.08 | 0.12 | 0.7 | 1.4 | 2.8 | 0.08 | 0.16 |
| 15 | 0.1 | 0.14 | 1.4 | 2.5 | 5 | 0.1 | 0.2 |

FIG.18

| |
|---|
| MODEL NAME: N<br>TYPE OF PAPER: PLAIN PAPER B<br>INK NAME: N INK<br>INK SET SETTING VALUE: SIX-COLOR INK |
| RESOLUTION SETTING VALUE: 1200 dpi<br>INK DROPLET SIZE SETTING VALUE: LARGE DROPLET<br>INK TOTAL AMOUNT CONTROL VALUE: DISCHARGE AMOUNT OF PRIMARY COLOR/TERTIARY COLOR<br>LINEARIZATION: ADJUSTMENT VALUE<br>NUMBER OF PATHS SETTING VALUE: 8<br>PRINTING DIRECTION SETTING VALUE: ONE DIRECTION<br>DISCHARGE ELECTRODE OUTPUT SETTING VALUE: 0.12 J/cm$^2$<br>ICC PROFILE SETTING VALUE: EACH PATCH INFORMATION |

PROCESSING OBJECT REFORMING APPARATUS, PRINTING APPARATUS, PROCESSING OBJECT REFORMING SYSTEM, PRINTING SYSTEM, AND MANUFACTURING METHOD OF PRINTED MATTER

CROSS-REFERENCE TO RELATED APPLICATIONS

The present application claims priority to and incorporates by reference the entire contents of Japanese Patent Application No. 2014-055631 filed in Japan on Mar. 18, 2014 and Japanese Patent Application No. 2014-237011 filed in Japan on Nov. 21, 2014.

BACKGROUND OF THE INVENTION

1. Field of the Invention

The present invention relates to a processing object reforming apparatus, a printing apparatus, a processing object reforming system, a printing system, and a manufacturing method of printed matter.

2. Description of the Related Art

Conventional ink jet recording apparatuses mainly use a shuttle method in which a head reciprocates in a width direction of a recording medium that is typically a sheet of paper and a film, so that it is difficult to improve throughput by high-speed printing. Therefore, in recent years, to achieve high-speed printing, a one-path method is proposed in which a plurality of heads are aligned so as to cover the entire width of the recording medium and recording is performed by using these heads at the same time.

Although the one-path method is advantageous for high-speed printing, the time interval by which adjacent dots are hit by ink droplets is short and an adjacent dot is hit by an ink droplet before an ink droplet jetted previously permeates into the recording medium. Therefore, there is a problem that adjacent dots are easily merged with each other (hereinafter this phenomenon is referred to as droplet interference) and image quality easily deteriorates. Conventional techniques are described in Japanese Patent No. 4662590, Japanese Patent Application Laid-open No. 2010-188568, and Japanese Patent Application Laid-open No. 2009-279796.

In view of the above situations, there is a need to provide a processing object reforming apparatus, a printing apparatus, a processing object reforming system, a printing system, and a manufacturing method of printed matter, which can reform a surface of a processing object so as to be able to manufacture high-quality printed matter.

SUMMARY OF THE INVENTION

It is an object of the present invention to at least partially solve the problems in the conventional technology.

According to an aspect of the present invention, there is provided a processing object reforming apparatus including a plasma processing unit that acidifies at least a surface of a processing object by processing the surface of the processing object by using plasma; and a control unit that controls the plasma processing unit to plasma-process the processing object with a plasma energy amount based on a type of the processing object.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 16 is a diagram illustrating a correspondence relationship between the resolution and the size of droplet according to the embodiment;

FIG. 17 is a diagram illustrating a correspondence relationship between the size of droplet, the type of paper, and the plasma energy according to the size of droplet and the type of paper according to the embodiment;

FIG. 18 is a diagram illustrating an example of the print setting table according to the embodiment;

DETAILED DESCRIPTION OF THE PREFERRED EMBODIMENTS

Figure 1:
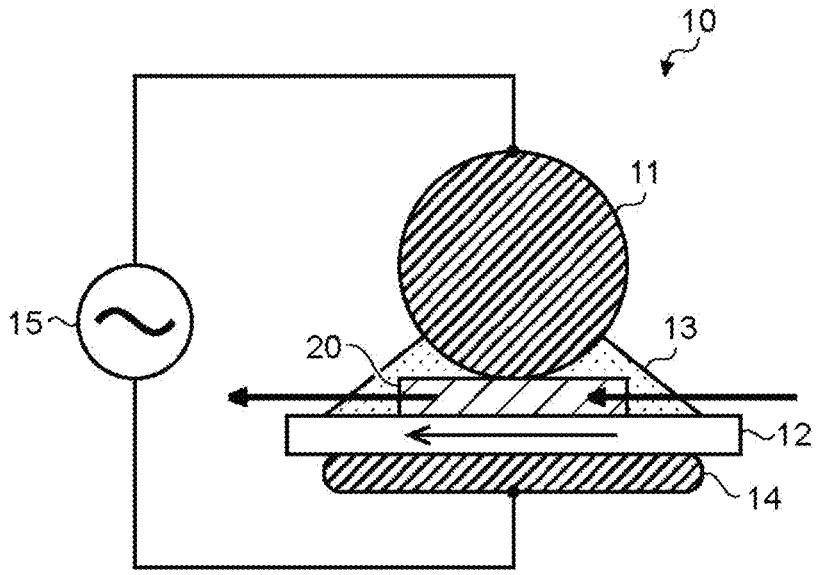
FIG. 1 is a schematic diagram of an example of a plasma processing apparatus for performing plasma processing employed in an embodiment.

Hereinafter, a preferred embodiment will be described in detail with reference to the accompanying drawings. The embodiment described below is a preferred embodiment of the present invention, so that technically preferred various limitations are imposed on the embodiment. However, the scope of the present invention is not unduly limited by the description below, and further not all the components described in the present embodiment are essential components of the present invention.

The embodiment has the features described below in order to reform a surface of a processing object and enable to manufacture high quality printed matter. That is, the embodiment realizes improvement of circularity of an ink dot, prevention of merging of dots, and thinning and homogenization of pigment aggregation thickness on a processing object by controlling the wettability of a reformed surface of the processing object and the aggregability and/or the permeability of ink pigment due to lowering of pH value. Thereby, it is possible to easily manufacture high quality printed matter with high productivity. Therefore, in the embodiment, a print control apparatus including, for example, a personal computer (hereinafter referred to as PC) and the like has a print setting table in which printing conditions suitable for a type of paper (brand and the like), an ink set to be used (hereinafter referred to as a use ink set), the resolution (or the size of liquid droplet), and the like are registered, so that it is possible to easily set an optimal printing condition by appropriately selecting the print setting table when printing is performed.

In the embodiment, it is possible to employ plasma processing as reforming processing of the surface of the processing object. Therefore, before describing the embodiment, an example of plasma processing employed in the embodiment will be described in detail with reference to the drawings. In the plasma processing employed in the embodiment, polymers in the surface of the processing object are reacted by irradiating the processing object with plasma in the atmosphere and hydrophilic functional groups are formed. Specifically, electrons e discharged from a discharge electrode are accelerated in an electric field and the electrons e excite and ionize atoms and molecules in the atmosphere. Electrons are also discharged from the ionized atoms and molecules and the number of high-energy electrons increases, so that a streamer discharge (plasma) occurs. A polymer binding (a coat layer of coated paper is fixed by calcium carbonate and starch used as a binder, and the starch has a polymer structure) of the surface of the processing object (for example, coated paper) is broken by the high-energy electrons generated by the streamer discharge and the polymers recombine with oxygen radical O*, hydroxyl radical (*OH), and ozone $O_3$. The above processing is called plasma processing. Thereby, polar functional groups such as hydroxyls and carboxyl groups are formed in the surface of the processing object. As a result, a hydrophilic property and an acidic property are given to the surface of the processing object. The surface of the processing object is acidified (pH value lowers) due to increase in the carboxyl groups.

The hydrophilic property of the surface of the processing object increases, so that dots adjacent to each other on the surface of the processing object are wetted and spread to merge with each other. To prevent occurrence of color mixture between dots due to the above phenomenon, it is necessary to quickly aggregate colorant (for example, pigment and dye) within a dot and dry a vehicle or cause the vehicle to permeate the processing object before the vehicle is wetted and spread. The plasma processing illustrated in the above description works as an acidification processing means (step) that acidifies the surface of the processing object, so that the plasma processing can increase the aggregation speed of the colorant within a dot. Also in this point, it is considered that it is effective to perform the plasma processing as preprocessing of ink jet recording processing.

In the embodiment, it is possible to employ, for example, atmospheric non-equilibrium plasma processing using dielectric barrier discharge as the plasma processing. In acidification processing by the atmospheric non-equilibrium plasma, the electron temperature is very high and the gas temperature is near normal temperature, so that the atmospheric non-equilibrium plasma processing is one of preferred plasma processing methods for a processing object such as a recording medium.

As a method of widely and stably generating the atmospheric non-equilibrium plasma, there is atmospheric non-equilibrium plasma processing that employs dielectric barrier discharge of a streamer dielectric breakdown type. It is possible to obtain the dielectric barrier discharge of the streamer dielectric breakdown type by, for example, applying an alternating high voltage between electrodes coated with a dielectric. However, as a method of generating the atmospheric non-equilibrium plasma, it is possible to use various methods besides the dielectric barrier discharge of the streamer dielectric breakdown type. For example, it is possible to apply a dielectric barrier discharge in which an insulator such as a dielectric is inserted between electrodes, a corona discharge that forms a significantly non-uniform electric field in a thin metal wire or the like, a pulse discharge that applies a short pulse voltage, and the like. Further, it is possible to combine two or more of these methods.

FIG. 1 is a schematic diagram of an example of a plasma processing apparatus for performing the plasma processing employed in the embodiment. As illustrated in FIG. 1, for the plasma processing employed in the embodiment, it is possible to use a plasma processing apparatus 10 including a discharge electrode 11, a counter electrode (also referred to as a grounding electrode) 14, a dielectric 12, a high frequency high voltage power supply 15. The dielectric 12 is arranged between the discharge electrode 11 and the counter electrode 14. The discharge electrode 11 and the counter electrode 14 may be an electrode whose metallic portion is exposed or may be an electrode coated with a dielectric or an insulator of insulation rubber, ceramic, or the like. The dielectric 12 arranged between the discharge electrode 11 and the counter electrode 14 may be an insulator of polyimide, silicon, ceramic, or the like. When the corona discharge is employed as the plasma processing, the dielectric 12 may be omitted. However, for example, when the dielectric barrier discharge is employed, it may be preferable to provide the dielectric 12. In this case, it is possible to more efficiently improve the effect of plasma processing when the dielectric 12 is arranged near or in contact with the counter electrode 14 than the case when the dielectric 12 is arranged near or in contact with the discharge electrode 11 because when the dielectric 12 is arranged near or in contact with the counter electrode 14, the area of creeping discharge increases. The discharge electrode 11 and the counter electrode 14 (or the dielectric 12 of an electrode that is provided with the dielectric 12) may be arranged at a position in contact with a processing object 20 that passes through between the two electrodes or may be arranged at a position not in contact with the processing object 20.

The high frequency high voltage power supply 15 applies a high frequency and high voltage pulse voltage between the discharge electrode 11 and the counter electrode 14. The voltage value of the pulse voltage is, for example, about 10 kV (kilovolt) (p-p). The frequency of the pulse voltage can be, for example, about 20 kHz (kilohertz). When such a high frequency and high voltage pulse voltage is supplied between the two electrodes, an atmospheric non-equilibrium plasma 13 is generated between the discharge electrode 11 and the dielectric 12. The processing object 20 passes through between the discharge electrode 11 and the dielectric 12 while the atmospheric non-equilibrium plasma 13 is being generated. Thereby, the surface of the processing object 20 facing the discharge electrode 11 is plasma-processed.

In the plasma processing apparatus 10 illustrated in FIG. 1, a rotary type discharge electrode 11 and a belt conveyer type dielectric 12 are employed. The processing object 20 is sandwiched and conveyed between the rotating discharge electrode 11 and the dielectric 12, so that the processing object 20 passes through the atmospheric non-equilibrium plasma 13. Thereby, the surface of the processing object 20 comes into contact with the atmospheric non-equilibrium plasma 13 and uniform plasma processing is applied to the surface of the processing object 20. However, the plasma processing apparatus employed in the embodiment is not limited to the configuration described above. For example, the plasma processing apparatus may have various modified configurations such as a configuration in which the discharge electrode 11 is close to the processing object 20 without coming into contact with the processing object 20 and a configuration in which the discharge electrode 11 is mounted on a carriage where an ink jet head is mounted. Besides the belt conveyer type dielectric 12, a flat plate type dielectric 12 can be employed.

Figure 2:
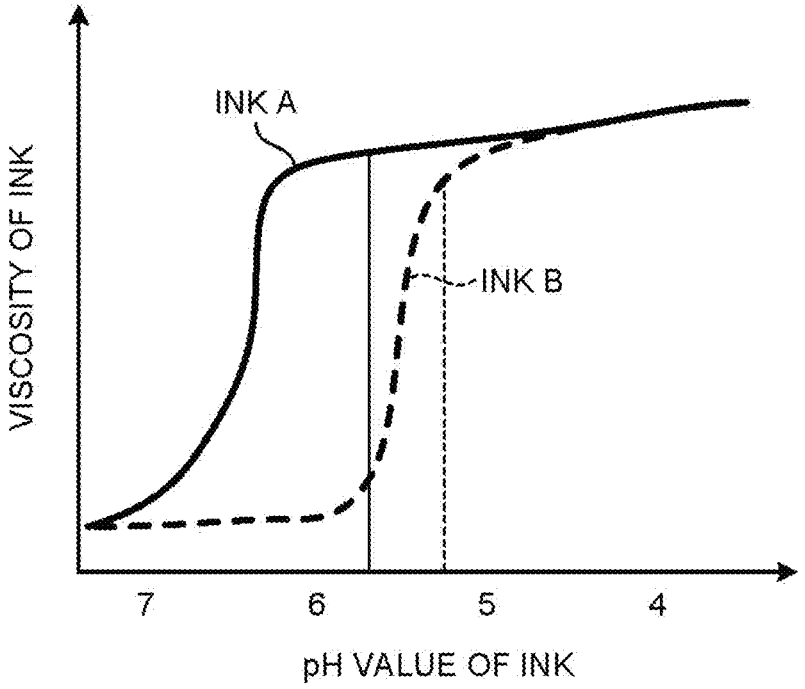
FIG. 2 is a diagram illustrating an example of a relationship between a pH value of ink and the viscosity of ink in the embodiment.

The acidification in the present description means to lower the pH value of a surface of a print medium to a pH value at which the pigment contained in an ink aggregate. To lower the pH value is to increase the concentration of hydrogen ion $H^+$ in an object. The pigment in the ink before the ink comes into contact with the surface of the processing object is negatively charged and dispersed in a liquid such as a vehicle. FIG. 2 illustrates an example of a relationship between the pH value of the ink and the viscosity of the ink. As illustrated in FIG. 2, as the pH value of the ink decreases, the viscosity of the ink increases. This is because more pigments that are negatively charged in the vehicle of the ink are electrically neutralized as the acidity of the ink increases, and as a result, the pigments aggregate. Therefore, it is possible to increase the viscosity of the ink by, for example, lowering the pH value of the surface of the print medium so that the pH value of the ink becomes a value corresponding to a required viscosity in the graph illustrated in FIG. 2. This is because when the ink is attached to the print medium surface which is acidic, the pigment is electrically neutralized by the hydrogen ions $H^+$ in the print medium surface, and as a result, the pigment aggregates. Thereby, it is possible to prevent color mixture between adjacent dots and to prevent the pigment from permeating the print medium deeply (further, to the back surface). However, to lower the pH value of the ink to a pH value corresponding to a required viscosity, it is necessary to set the pH value of the surface of the print medium to lower than the pH value of the ink corresponding to the required viscosity.

The pH value to obtain the required viscosity of the ink varies depending on the characteristics of the ink. Specifically, while there is an ink where the pigment aggregates and the viscosity increases at a pH value relatively near neutral as illustrated by the ink A in FIG. 2, there is an ink where a pH value lower than that of the ink A is required to cause the pigment to aggregate as illustrated by the ink B having characteristics different from those of the ink A.

The behavior in which the colorant aggregates in a dot, the drying speed of vehicle, and the permeating speed of vehicle into the processing object vary depending on the size of liquid droplet that varies according to the size of dot (small droplet, intermediate droplet, and large droplet) and the type of the processing object. Therefore, in the embodiment, the plasma energy amount in the plasma processing may be controlled to an optimal value according to the type of the processing object and a print mode (the size of liquid droplet).

Figure 3:
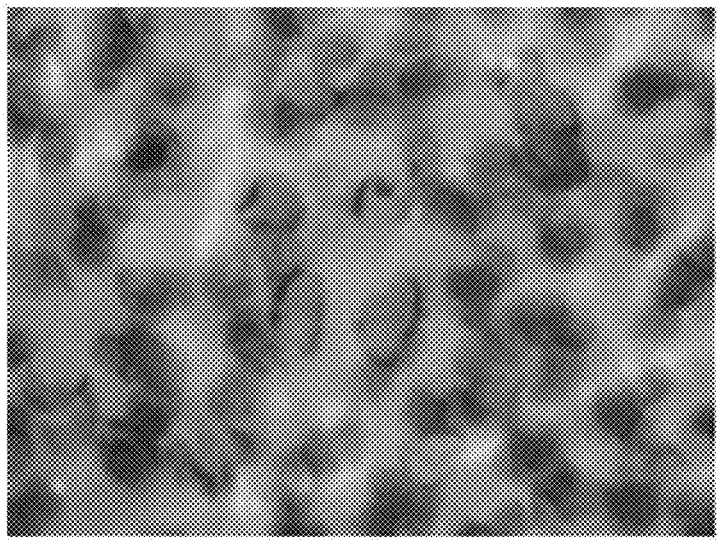
FIG. 3 is an enlarged view of an image obtained by capturing an image of an image forming surface of a printed matter obtained by performing ink jet recording processing on a processing object to which the plasma processing according to the embodiment is not applied.
Figure 4:
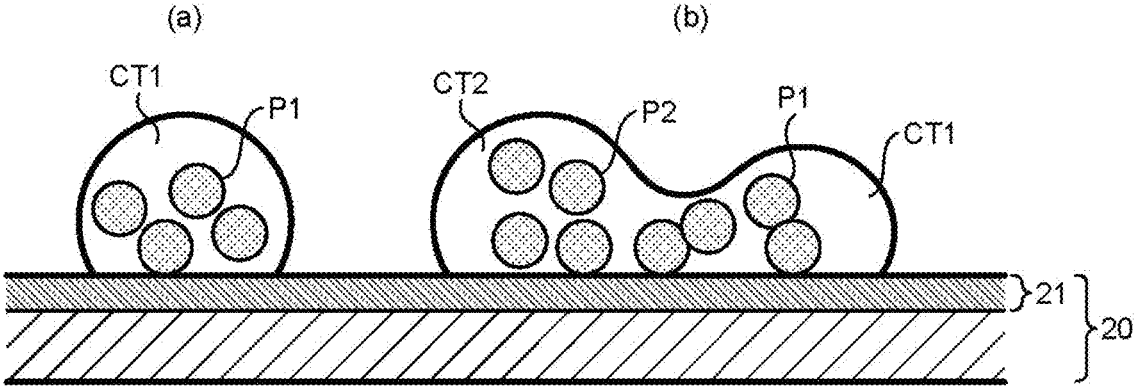
FIG. 4 is a schematic diagram illustrating an example of dots formed on the image forming surface of the printed matter illustrated in FIG. 3.
Figure 5:
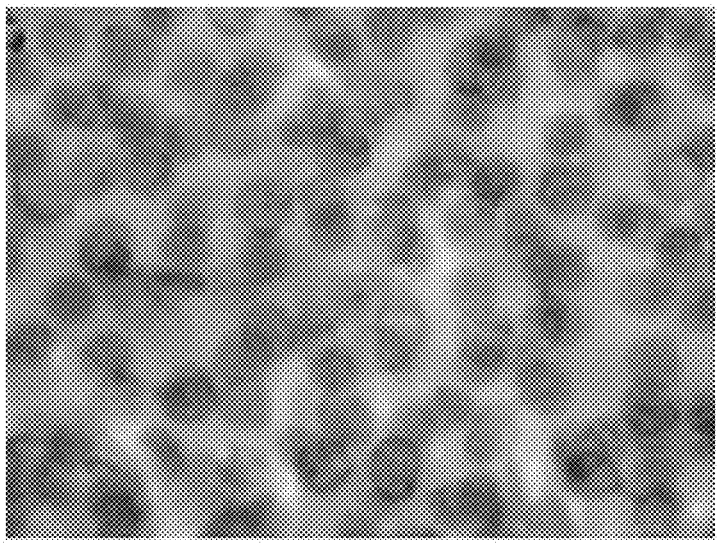
FIG. 5 is an enlarged view of an image obtained by capturing an image of an image forming surface of a printed matter obtained by performing ink jet recording processing on a processing object on which the plasma processing according to the embodiment is performed.
Figure 6:
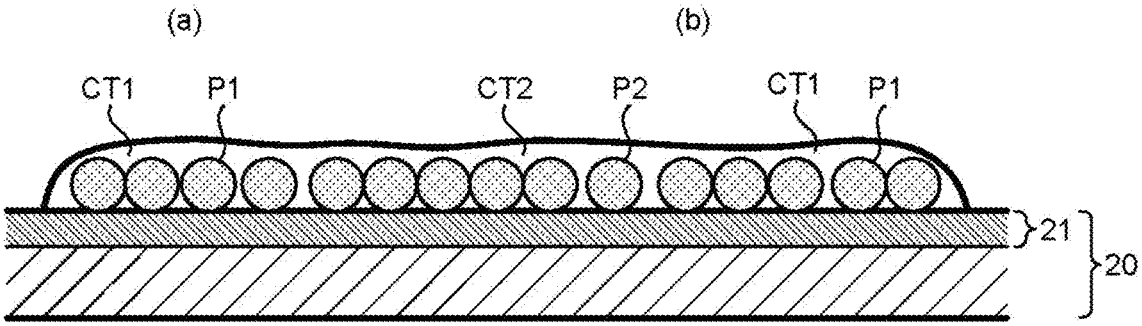
FIG. 6 is a schematic diagram illustrating an example of dots formed on the image forming surface of the printed matter illustrated in FIG. 5.

Here, a difference between a printed matter to which the plasma processing according to the embodiment is applied and a printed matter to which the plasma processing according to the embodiment is not applied will be described with reference to FIGS. 3 to 6. FIG. 3 is an enlarged view of an image obtained by capturing an image of an image forming surface of a printed matter obtained by performing ink jet recording processing on a processing object to which the plasma processing according to the embodiment is not applied. FIG. 4 is a schematic diagram illustrating an example of dots formed on the image forming surface of the printed matter illustrated in FIG. 3. FIG. 5 is an enlarged view of an image obtained by capturing an image of an image forming surface of a printed matter obtained by performing ink jet recording processing on a processing object to which the plasma processing according to the embodiment is applied. FIG. 6 is a schematic diagram illustrating an example of dots formed on the image forming surface of the printed matter illustrated in FIG. 5. A desktop-type ink jet recording apparatus is used to obtain the printed matters illustrated in FIGS. 3 and 5. As the processing object 20, a normal coated paper including a coat layer 21 is used.

Regarding a coated paper to which the plasma processing is not applied, the wettability of the coat layer 21 located at the surface of the coated paper is not good. Therefore, in an image formed on a coated paper, to which the plasma processing is not applied, by the ink jet recording processing, for example, as illustrated in FIGS. 3 and 4, the shape of the dot (the shape of the vehicle CT1) that is attached to the surface of the coated paper when the dot lands is distorted. Further, when adjacent dots are formed in a state in which the dots are not sufficiently dried, as illustrated in FIGS. 3 and 4, the vehicles CT1 and CT2 are merged when the adjacent dots land on the coated paper, and thereby the pigment P1 and the pigment P2 move (color mixture occurs) between the dots. As a result, density unevenness due to the beading or the like may occur.

On the other hand, regarding a coated paper to which the plasma processing is applied, the wettability of the coat layer 21 located at the surface of the coated paper is improved. Therefore, in an image formed on a coated paper, to which the plasma processing is applied, by the ink jet recording processing, for example, as illustrated in FIG. 5, the vehicle CT1 spreads on the surface of the coated paper in a relatively flat perfect circular shape. Thereby, the dot has a flat shape as illustrated in FIG. 6. Further, the surface of the coated paper is acidified by polar functional groups formed by the plasma processing, so that the ink pigment is electrically neutralized and the pigment P1 aggregates to increase the viscosity of the ink. Thereby, even when the vehicle CT1 and CT2 are merged as illustrated in FIG. 6, the movement (color mixture) of the pigment P1 and the pigment P2 between the dots is suppressed. Further, the polar functional groups are also formed in the coat layer 21, so that the permeability of the vehicle CT1 increases. Thereby, the dots can be dried in a relatively short time. A dot that spreads in a perfect circular shape due to increase in wettability aggregates while permeating, so that the pigment P1 is uniformly aggregated in the height direction and it is possible to suppress the density unevenness due to the beading or the like. FIGS. 4 and 6 are schematic diagrams. In practice, the pigment aggregates in layers even in the case of FIG. 6.

In this way, in the processing object 20 to which the plasma processing according to the embodiment is applied, the hydrophilic functional groups are generated in the surface of the processing object 20, so that the wettability is improved. Further, the surface roughness of the processing object 20 is increased by the plasma processing. As a result, the wettability of the surface of the processing object 20 is further improved. The surface of the processing object 20 is acidified as a result of formation of the polar functional groups by the plasma processing. By these, the landed ink uniformly spreads on the surface of the processing object 20, and the negatively charged pigment is neutralized on the surface of the processing object 20, so that the pigment aggregates and the viscosity increases. As a result, even when dots are merged eventually, it is possible to suppress the movement of the pigment. Further, the polar functional groups are also formed in the coat layer 21 formed on the surface of the processing object 20, so that the vehicle quickly permeates inside the processing object 20, and thereby it is possible to shorten the drying time. In other words, the dot that spreads in a perfect circular shape due to increase in wettability permeates in a state in which the movement of the pigment is suppressed by the aggregation, so that the dot can keep the shape close to a perfect circle.

Figure 7:
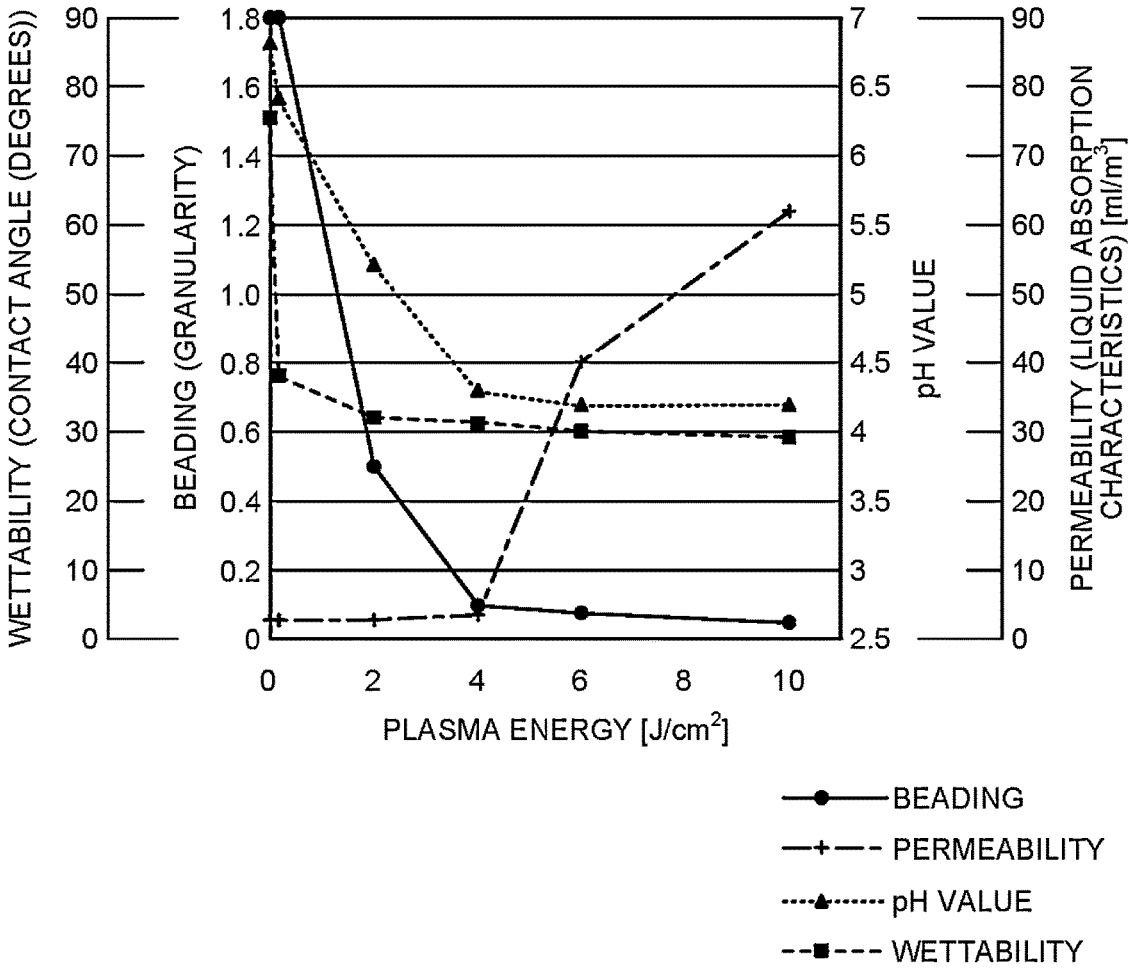
FIG. 7 is a graph illustrating a relationship between the plasma energy and the wettability, the beading, a pH value, and the permeability of a surface of a processing object according to the embodiment.

FIG. 7 is a graph illustrating a relationship between the plasma energy and the wettability, the beading, the pH value, and the permeability of the surface of the processing object according to the embodiment. FIG. 7 illustrates how the surface characteristics (the wettability, the beading, the pH value, and the permeability (liquid absorption characteristics)) of a coated paper change depending on the plasma energy amount when printing is performed on the coated paper used as the processing object 20. When obtaining the evaluation illustrated in FIG. 7, an aqueous pigment ink (an alkaline ink in which negatively charged pigment is dispersed) having characteristics where the pigment aggregates by acid is used as an ink.

As illustrated in FIG. 7, the wettability of the surface of the coated paper rapidly improves when the value of the plasma energy is low (for example, about 0.2 $J/cm^2$ or less), and the wettability does not improve so much when the energy is increased from about 0.2 $J/cm^2$. On the other hand, the pH value of the surface of the coated paper lowers to some extent by increasing the plasma energy. However, the pH value is saturated when the plasma energy exceeds a certain value (for example, about 4 $J/cm^2$). The permeability (liquid absorption characteristics) rapidly improves from when the lowering of pH is saturated (for example, about 4 $J/cm^2$). However, this phenomenon varies depending on a polymer component contained in ink.

As described above, regarding a relationship between the characteristics of the surface of the processing object 20 and the quality of image, when the wettability of the surface improves, the circularity of a dot improves. As a reason of this, it is considered that the wettability of the surface of the processing object 20 is improved and homogenized by the increase of surface roughness due to the plasma processing and the hydrophilic polar functional groups generated by the plasma processing. Also it is considered that removal of water repellent factors such as dust, oil, and calcium carbonate on the surface of the processing object 20 by the plasma processing is one of the reasons of the above. In summary, it is considered that the wettability of the surface of the processing object 20 is improved and factors of instability of the surface of the processing object 20 are removed, so that the liquid droplet spreads uniformly in the circumferential direction and the circularity of a dot improves.

When the surface of the processing object 20 is acidified (pH is lowered), the aggregation of ink pigment, the improvement of permeability, and the permeation of vehicle into the coat layer, and the like occur. By these, the density of the pigment of the surface of the processing object 20 increases, so that even if dots are merged, it is possible to suppress the movement of the pigment. As a result, mixture of the pigments is suppressed, so that it is possible to uniformly settle and aggregate the pigment on the surface of the processing object. However, the suppression effect of the mixture of the pigments varies depending on the components of the ink and the size of droplet of the ink. For example, when the size of ink droplet is small, the mixture of pigments due to merge of dots is difficult to occur as compared with the case when the size of ink droplet is large. This is because when the amount of vehicle is small, the vehicle dries and permeates more quickly and the pigment can be aggregated by a small pH reaction. The effect of the plasma processing varies depending on the type of the processing object 20 and the environment (humidity and the like). Therefore, it is possible to control the plasma energy amount in the plasma processing to an optimal value according to the size of liquid droplet, the type of the processing object 20, the environment, and the like. As a result, the surface reforming effect of the processing object 20 improves, so that it is possible to achieve further power saving.

Figure 8:
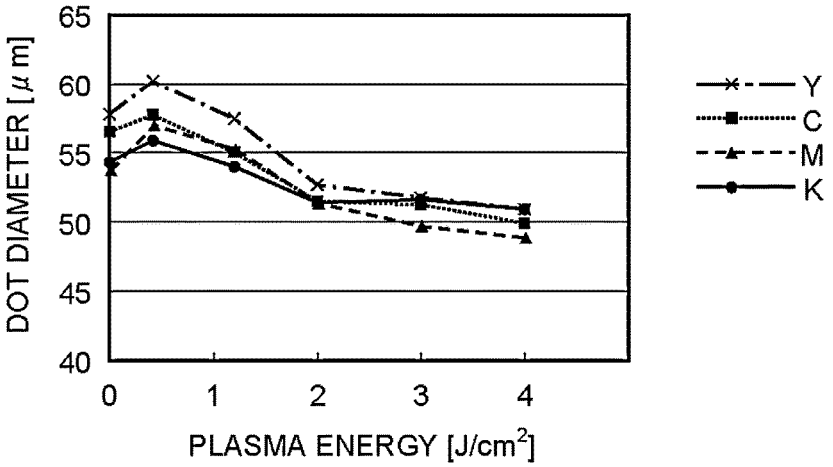
FIG. 8 is a graph illustrating a relationship between the plasma energy and a dot diameter.
Figure 9:
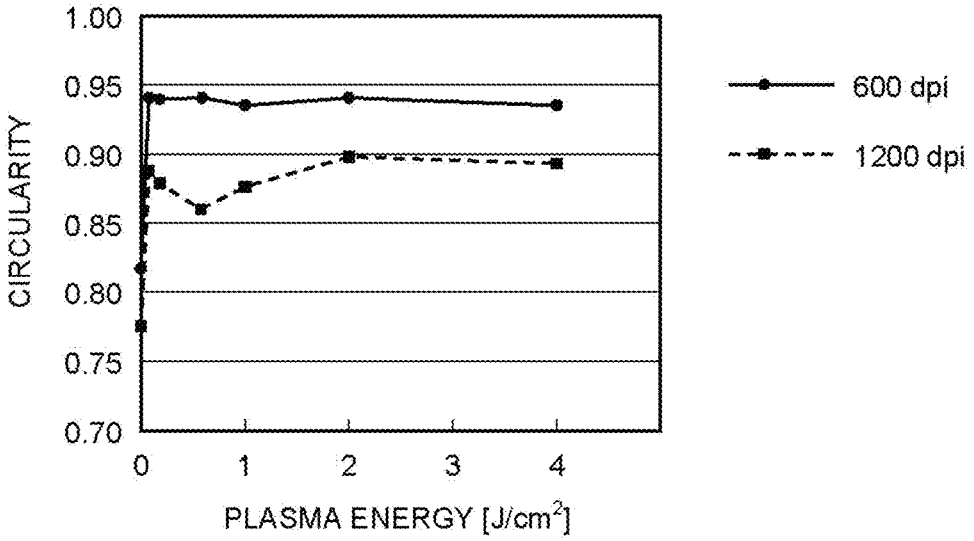
FIG. 9 is a graph illustrating a relationship between the plasma energy and the circularity of a dot according to the embodiment.
Figure 10:
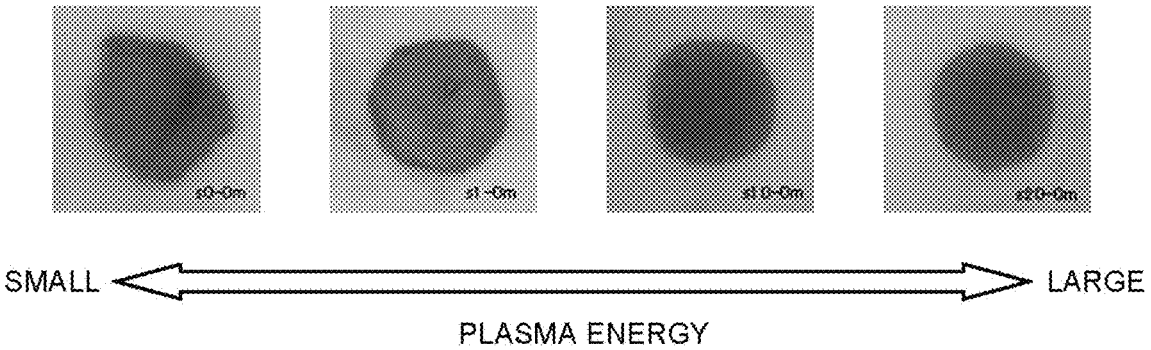
FIG. 10 is a diagram illustrating a relationship between the plasma energy amount and shapes of a dot that is actually formed according to the embodiment.

Here, a relationship between the plasma energy amount and the circularity of a dot will be described. FIG. 8 is a graph illustrating a relationship between the plasma energy and a dot diameter. FIG. 9 is a graph illustrating a relationship between the plasma energy and the circularity of a dot. FIG. 10 is a diagram illustrating a relationship between the plasma energy amount and shapes of a dot that is actually formed. FIGS. 8 to 10 illustrate a case where an ink of the same type and the same color is used.

As illustrated in FIG. 8, when the plasma energy is large, the dot diameter tends to be small for any pigment of CMYK. This is because it is considered that as a result of the plasma processing, the aggregation effect of pigment (increase in viscosity due to aggregation) and the permeability effect (permeation of vehicle into the coat layer 21) are improved and thereby a dot quickly aggregates and permeates in a process in which the dot spreads. It is possible to control the dot diameter by using such effects. In other words, it is possible to control the dot diameter by controlling the plasma energy amount.

As illustrated in FIGS. 9 and 10, the circularity of a dot is significantly improved even when the value of the plasma energy is low (for example, about 0.2 $J/cm^2$ or less). This is because it is considered that the viscosity of a dot (vehicle) is increased and the permeability of vehicle is increased by plasma-processing the processing object 20 as described above and thereby the pigment is uniformly aggregated.

Figure 11:
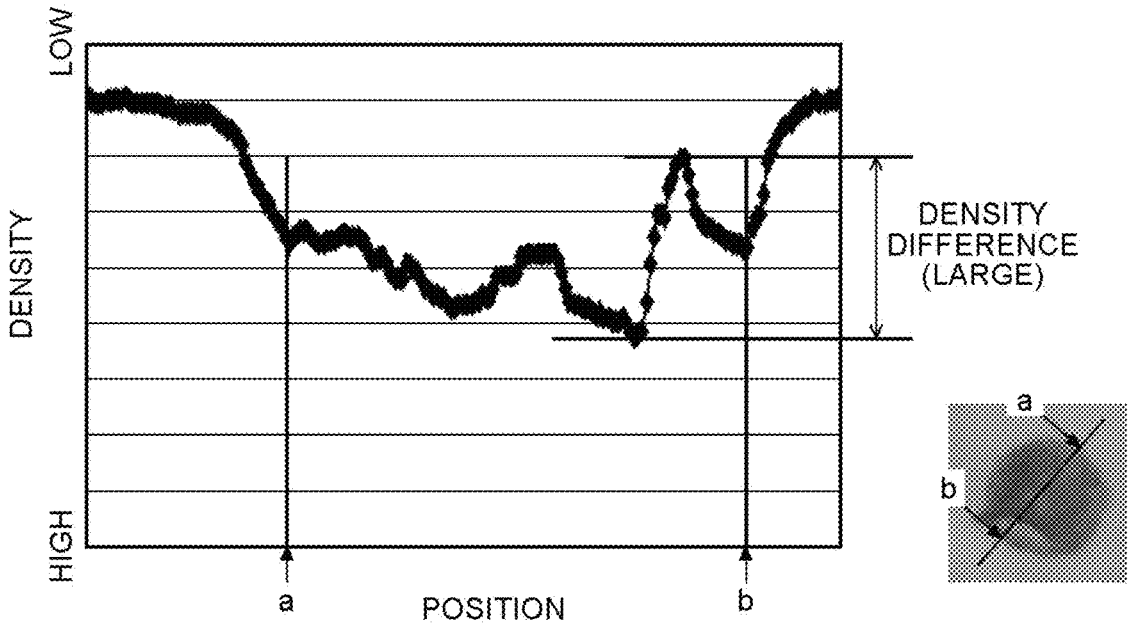
FIG. 11 is a graph illustrating a pigment density in a dot when the plasma processing according to the embodiment is not performed.
Figure 12:
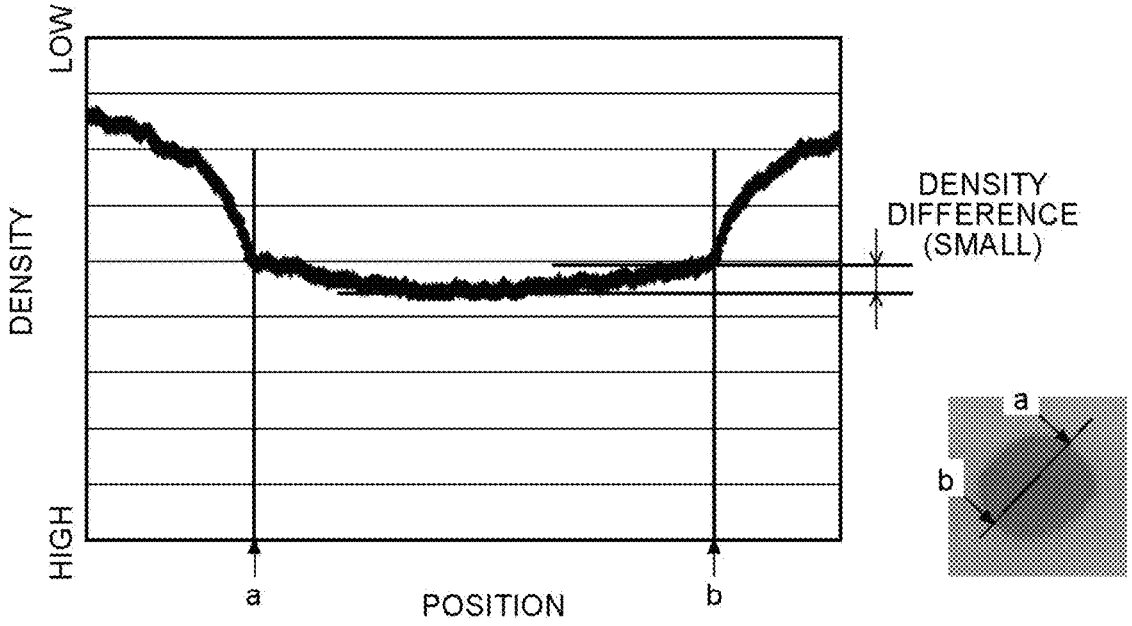
FIG. 12 is a graph illustrating the pigment density in a dot when the plasma processing according to the embodiment is performed.

A case where the plasma processing is performed for pigment unevenness in a dot and a case where the plasma processing is not performed for pigment unevenness in a dot will be described. FIG. 11 is a graph illustrating the density of a dot when the plasma processing according to the embodiment is not performed. FIG. 12 is a graph illustrating the density of a dot when the plasma processing is performed. FIGS. 11 and 12 illustrate the density on a ling segment a-b in a dot image located at lower right in each figure.

In the measurements of FIGS. 11 and 12, an image of a formed dot is taken, the density unevenness of the image is measured, and the variation of the density is calculated. As obvious from the comparison of FIGS. 11 and 12, when the plasma processing is performed (FIG. 12), it is possible to make the variation of the density (density difference) smaller than that when the plasma processing is not performed (FIG. 11). Therefore, the plasma energy amount in the plasma processing may be optimized so as to minimize the variation (desist difference) on the basis of the variation of the density obtained by the calculation method as described above. Thereby, it is possible to form a clearer image.

The variation of the density may be calculated not only by the calculation method described above, but also by measuring the thickness of the pigment by using an optical interference film thickness measurement means. In this case, an optimal value of the plasma energy amount may be selected so as to minimize the deviation of the thickness of the pigment.

Next, a processing object reforming apparatus, a printing apparatus, a processing object reforming system, a printing system, and a manufacturing method of printed matter according the embodiment will be described in detail with reference to the drawings. In the embodiment, an image forming apparatus including a discharge head (a recording head or an ink head) of four colors including black (K), cyan (C), magenta (M), and yellow (Y) will be described. However, the discharge head is not limited to the discharge head described above. That is, the image forming apparatus may further include a discharge head using green (G), red (R), and other colors or may include a discharge head using only black (K). In the description below, K, C, M, and Y correspond to black, cyan, magenta, and yellow, respectively.

In the embodiment, continuous forms rolled into a cylinder shape (hereinafter referred to as a rolled paper) are used as the processing object. However, the processing object is not limited to the rolled paper, but may be a recording medium such as a cut paper on which an image can be formed. When the processing object is paper, as the types of paper, for example, plain paper, high-quality paper, recycled paper, thin paper, thick paper, and coated paper can be used. Further, an object, such as an OHP sheet, a synthetic resin film, a metallic thin film, and the like, on the surface of which an image can be formed by ink or the like, can be used as the processing object. Here, the rolled paper may be continuous forms (continuous form paper or continuous business forms) where perforations are formed at predetermined intervals. In this case, a page in the rolled paper is, for example, a region sandwiched by perforations formed at predetermined intervals.

Figure 13:
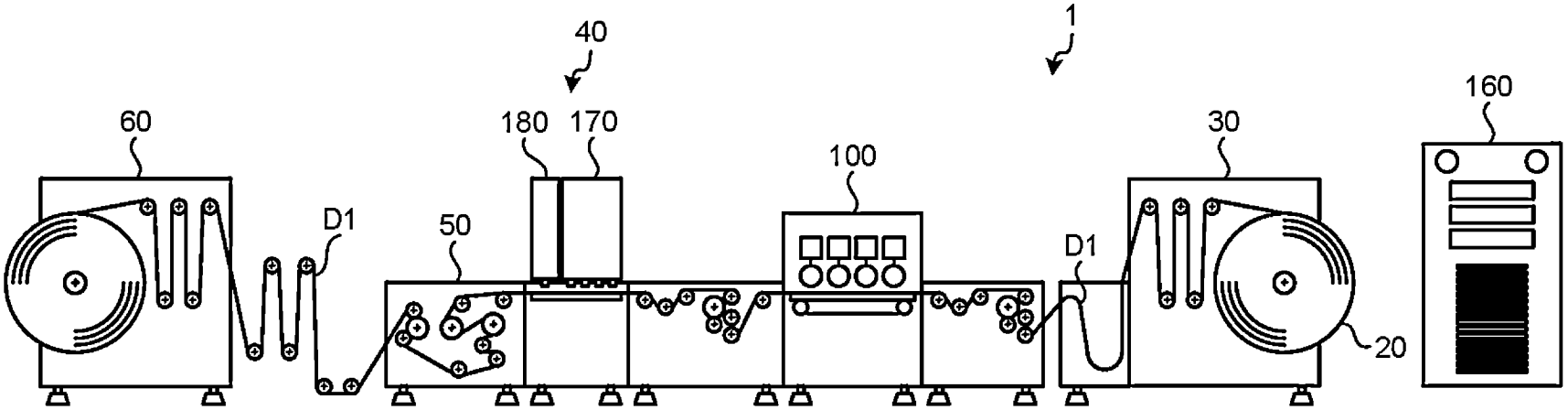
FIG. 13 is a schematic diagram illustrating an outline configuration example of a printing apparatus (system) according to the embodiment.

FIG. 13 is a schematic diagram illustrating an outline configuration example of the printing apparatus (system) according to the embodiment. As illustrated in FIG. 13, the printing apparatus (system) 1 includes a carry-in unit 30 that carries in (conveys) the processing object 20 (rolled paper) along a conveyance path D1, a plasma processing apparatus 100 that applies the plasma processing to the carried-in processing object 20 as preprocessing, and an image forming apparatus 40 that forms an image on a surface of the plasma-processed processing object 20. The image forming apparatus 40 can include an ink jet head 170 that forms an image on the plasma-processed processing object 20 by ink jet processing and a pattern reading unit 180 that reads the image formed on the processing object 20. The image forming apparatus 40 may include a post-processing unit that post-processes the processing object 20 on which an image is formed. Further, the printing apparatus (system) 1 may include a drying unit 50 that dries the post-processed processing object 20 and a carry-out unit 60 that carries out the processing object 20 on which an image is formed (and which may be further post-processed). The pattern reading unit 180 may be provided on the downstream side of the drying unit 50 on the conveyance path D1. Further, the printing apparatus (system) 1 may include a control unit 160 that generates raster data from image data for printing and controls each unit in the printing apparatus (system) 1. The control unit 160 can communicate with the printing apparatus (system) 1 through a wired or wireless network. The control unit 160 need not be configured by a single computer and may have a configuration in which a plurality of computers are connected through a network such as LAN (Local Area Network). The control unit 160 may have a configuration including a control unit individually provided to each unit in the printing apparatus (system) 1. When the printing apparatus (system) 1 is configured as a printing system, the control unit 160 may be included in any one of devices.

Each unit (device) illustrated in FIG. 13 may be separated into different housings and configure the printing system 1 as a whole or may be included in the same housing to configure the printing device 1. When the printing apparatus (system) 1 is configured as the printing system 1, the control unit 160 may be included in any one of units and devices.

Next, the printing apparatus (system) 1 according to the embodiment will be described in more detail. In the printing apparatus (system) 1, a pattern reading unit that acquires an image of formed dots is provided on the downstream side of an ink jet recording unit. It is possible to configure the printing apparatus (system) 1 so that the printing apparatus (system) 1 calculates the circularity of a dot, the dot diameter, the variation of the density, and the like by analyzing the acquired image and feedback-controls or feed-forward controls a plasma processing unit based on the calculation result.

Figure 14:
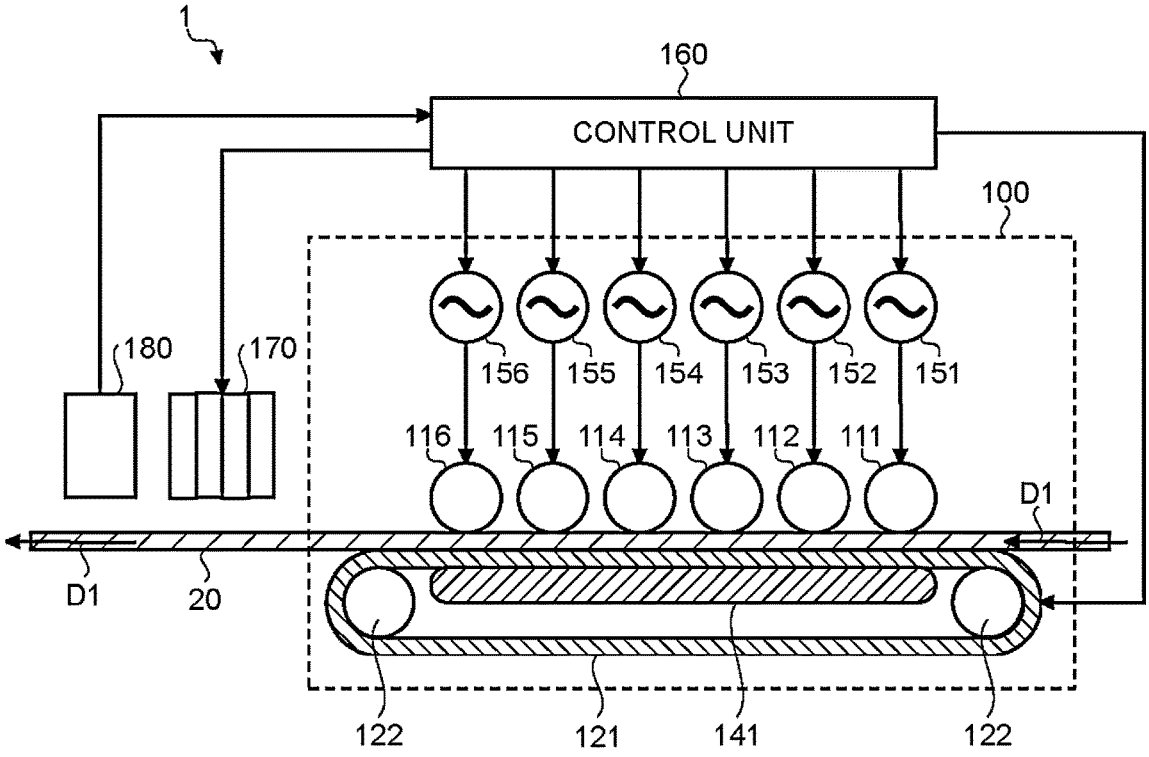
FIG. 14 is a schematic diagram illustrating an outline configuration example of a section from the plasma processing apparatus to a pattern reading unit arranged on the downstream side of an ink jet recording apparatus in the printing apparatus (system) according to the embodiment.

FIG. 14 illustrates an outline configuration example of a section from the plasma processing apparatus to the pattern reading unit arranged on the downstream side of an ink jet recording apparatus in the printing apparatus (system) 1 according to the embodiment. The other components are the same as those in the printing apparatus (system) 1 illustrated in FIG. 13, so that the detailed description will be omitted.

As illustrated in FIG. 14, the printing apparatus (system) 1 includes the plasma processing apparatus 100 arranged on the upstream side of the conveyance path D1, the ink jet head 170 arranged on the downstream side of the plasma processing apparatus 100 on the conveyance path D1, the pattern reading unit 180 arranged on the downstream side of the ink jet head 170, and the control unit 160 that controls each unit in the plasma processing apparatus 100. The ink jet head 170 forms an image by discharging ink to the processing object 20, the surface of which is plasma-processed by the plasma processing apparatus 100 arranged on the upstream side. The ink jet head 170 may be controlled by a control unit arranged separately (not illustrated in the drawings) or may be controlled by the control unit 160.

The plasma processing apparatus 100 includes a plurality of discharge electrodes 111 to 116 arranged along the conveyance path D1, high frequency high voltage power supplies 151 to 156 that supply a high frequency and high voltage pulse voltage to the discharge electrodes 111 to 116, a counter electrode 141 provided in common to the plurality of discharge electrodes 111 to 116, a belt conveyer type endless dielectric 121 arranged as if flowing along the conveyance path D1 between the discharge electrodes 111 to 116 and the counter electrode 141, and a roller 122. The processing object 20 is plasma-processed while being conveyed in the conveyance path D1. When using the plurality of discharge electrodes 111 to 116 arranged along the conveyance path D1, it is preferable that an endless belt is used as the dielectric 121 as illustrated in FIG. 14.

The control unit 160 circulates the dielectric 121 by driving the roller 122. When the processing object 20 is carried in on the dielectric 121 from the upstream carry-in unit 30 (see FIG. 13), the processing object 20 passes through the conveyance path D1 by the circulation of the dielectric 121.

The control unit 160 can individually turn on and off the plurality of high frequency high voltage power supplies 151 to 156. The high frequency high voltage power supplies 151 to 156 respectively supply a high frequency and high voltage pulse voltage to the plurality of discharge electrodes 111 to 116 according to an instruction from the control unit 160.

The pulse voltage may be supplied to all the discharge electrodes 111 to 116 or may be supplied to some of the discharge electrodes 111 to 116. Specifically, the pulse voltage may be supplied to a necessary number of discharge electrodes in order to set the pH value of the surface of the processing object 20 to lower than or equal to a predetermined pH value. Alternatively, the control unit 160 may adjust the plasma energy amount to an amount necessary to set the pH value of the surface of the processing object 20 to lower than or equal to a predetermined pH value by adjusting the frequency and the voltage value of the pulse voltage supplied from each of the high frequency high voltage power supplies 151 to 156. Further, the control unit 160 may adjust the plasma energy amount to the processing object 20 by selecting the number of high frequency high voltage power supplies 151 to 156 to be driven (that is, by selecting the number of discharge electrodes to which the pulse voltage is applied). Further, the control unit 160 may adjust the number of high frequency high voltage power supplies 151 to 156 to be driven and/or the plasma energy amount to be given to each of the discharge electrodes 111 to 116 according to, for example, printing speed information and the type of the processing object 20 (for example, coated paper, PET film, and the like).

Here, as one of methods of obtaining the plasma energy amount required to necessarily and sufficiently plasma-process the surface of the processing object 20, increasing the time of plasma processing can be considered. This can be realized by, for example, slowing the conveyance speed of the processing object 20. However, it is desired to shorten the time of plasma processing to improve the throughput of print processing. As a method of shortening the time of plasma processing, as described above, a method in which a plurality of discharge electrodes 111 to 116 are prepared and a necessary number of discharge electrodes 111 to 116 are driven according to the printing speed and a necessary plasma energy amount, a method of adjusting the plasma energy amount given to the processing object 20 by each of the discharge electrodes 111 to 116, and the like are considered. However, the method is not limited to these methods, but the method can be appropriately changed such as combining these methods or using another method.

Further, providing a plurality of discharge electrodes 111 to 116 is effective to uniformly plasma-process the surface of the processing object 20. Specifically, for example, if the conveyance speed (or the printing speed) is the same, when the plasma processing is performed by a plurality of discharge electrodes, the time in which the processing object 20 passes through the space of plasma can be longer than that when the plasma processing is performed by one discharge electrode. As a result, it is possible to apply the plasma processing more uniformly to the processing object 20.

In FIG. 14, for example, the pattern reading unit 180 captures an image of dots in an image formed on the processing object 20. In the description below, an example will be described in which the captured image is an analysis dot pattern formed in the image.

The image acquired by the pattern reading unit 180 is inputted into the control unit 160. The control unit 160 calculates the circularity of a dot, the dot diameter, the variation of the density, and the like in the analysis dot pattern by analyzing the inputted image and adjusts the number of discharge electrodes 111 to 116 to be driven and/or the plasma energy amount of the pulse voltage supplied from each of the high frequency high voltage power supplies 151 to 156 to each of the discharge electrodes 111 to 116 based on the calculation result.

As the ink jet head 170, a plurality of the same color heads (four colors×four heads) may be included. Thereby, it is possible to increase the speed of ink jet recording processing. In this case, for example, to achieve a resolution of 1200 dpi at high speed, the heads of each color in the ink jet head 170 are shifted and fixed so as to correct the intervals between nozzles that discharge ink. Further, a drive pulse of a drive frequency with some variations is inputted into heads of each color so that the dots of ink discharged from the nozzles correspond to three types of sizes called a small droplet, an intermediate droplet, and a large droplet.

Figure 15:
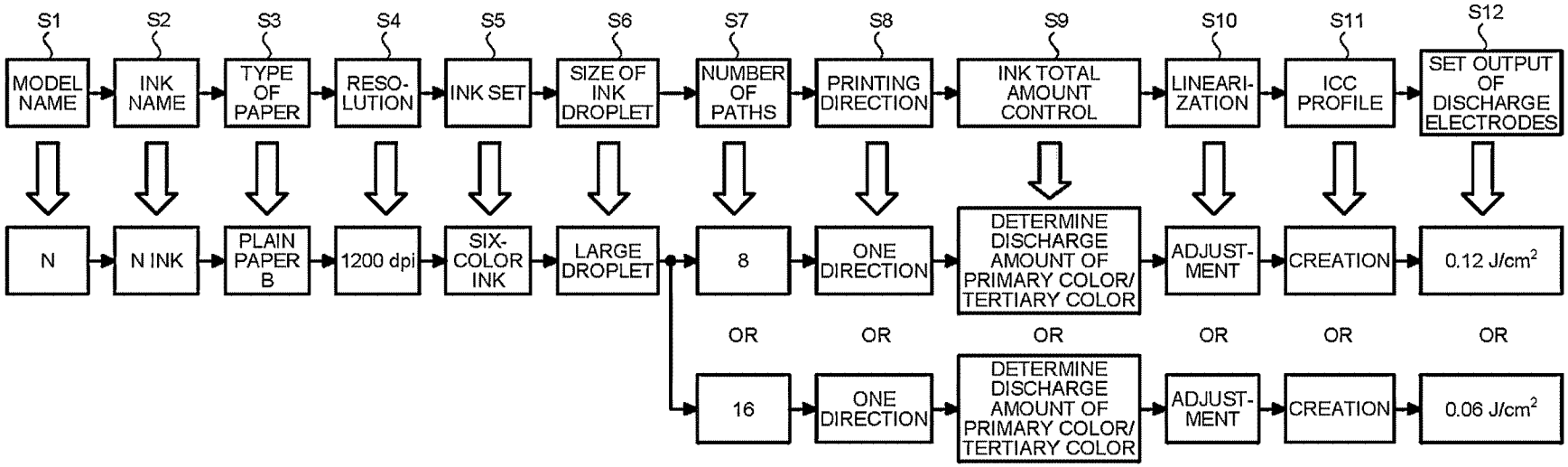
FIG. 15 is a creation procedure chart of a print setting table according to the embodiment.

Next, creation of the print setting table used in the embodiment will be described in detail with reference to the drawings. FIG. 15 is a creation procedure chart of the print setting table according to the embodiment. FIG. 16 is a diagram illustrating a correspondence relationship between the resolution and the size of droplet according to the embodiment. FIG. 17 is a diagram illustrating a correspondence relationship between the size of droplet, the type of paper, and the plasma energy amount according to the size of droplet and the type of paper according to the embodiment. FIG. 18 is a diagram illustrating an example of the print setting table according to the embodiment. The procedure illustrated in FIG. 15 may be performed by a user by using the printing apparatus (system) 1, a print control apparatus not illustrated in the drawings, or a terminal such as a PC. For simplicity of the following description, an apparatus used by a user to create the print setting table is simply referred to as a setting terminal.

As illustrated in FIG. 15, in the creation of the print setting table, first, a model name (step S1) of the printing apparatus (system) 1, a brand of ink (step S2), a type of paper of the processing object 20 (step S3), the resolution (step S4), and an ink set (step S5) are set. In the example illustrated in FIG. 15, "N" is set as the model name (step S1), "N ink" is set as the brand of ink (also referred to as an ink name) (step S2), "plain paper B" is set as the type of paper (step S3), "1200 dpi" is set as the resolution (step S4), and "six-color ink" is set as the ink set (step S5). The setting of steps S1 to S5 may be inputted by a user as needed. In this case, in the embodiment, the number of created print setting tables is the number of combinations set by the user from among the combination of the model name, the brand of ink, the type of paper, the resolution, and the ink set.

Subsequently, the size of droplet of an ink dot (also referred to as the size of ink droplet) used for printing is set (step S6). For example, the size of ink droplet is set based on a correspondence relationship between the resolution and the size of droplet illustrated in FIG. 16. For example, the setting terminal holds a correspondence relationship table illustrated in FIG. 16 and may automatically set a corresponding size of ink droplet according to the resolution inputted in step S4.

Subsequently, the setting terminal determines whether the target printing apparatus (system) is a serial type printer or a line type printer from, for example, the model name inputted in step S1. When the target printing apparatus (system) is a serial type printer, the setting terminal sets the number of paths during printing (step S7) and a printing direction (step S8). In the setting of the number of paths, the number of paths into which the ink is divided and discharged is set. In the setting of the printing direction, for example, it is set whether, upon movement in a scanning direction (main-scanning direction) of a carriage on which the ink jet head 170 is mounted in the serial type printer, the ink is discharged when the carriage moves in one direction (forward direction or backward direction) or the ink is discharged when the carriage moves in both directions (forward direction and backward direction).

Subsequently, the setting terminal performs setting of ink total amount control (step S9) and adjustment of linearization (step S10). In the setting of the ink total amount control, for example, an upper limit value of a discharge amount of primary color ink and an upper limit value of a discharge amount of tertiary color ink are set. In the setting of the upper limit value of the discharge amount of primary color ink, for example, the printing density is varied from 0 to 100% and the upper limit value of the discharge amount where printing failure such as beading, bleeding, and feathering does not occur in a solid image of primary color such as yellow, magenta, cyan, and black is set as the upper limit value of the discharge amount of primary color ink of printing density 100%. The discharge amount of primary color ink whose printing density is less than 100% is assigned to be equivalent between 0% and 100% of printing density. In the same manner, the upper limit value of the discharge amount of secondary color ink related to green, blue, and red and the upper limit value of the discharge amount of composite black formed from yellow, magenta, and cyan are determined, and the ink discharge amounts of the secondary color and the composite black are assigned to be equivalent between 0% and 100% of printing density. Further, in the same manner, the upper limit value of the discharge amount of tertiary color ink and the ink discharge amount of tertiary color where the ink discharge amount is equivalent between 0% and 100% of printing density are assigned. In the adjustment of linearization, the gradation of colors obtained as a printing result is adjusted.

Subsequently, when document image data to be printed is determined, the setting terminal creates an ICC profile from color information (for example, RGB values) of the document image data (step S11). However, when the document image data to be printed is not determined, the creation of the ICC profile may be performed separately by, for example, the print control apparatus or the printing apparatus (system) 1. When the document image data has the ICC profile in advance, in step S11, it is possible to perform processing to convert the ICC profile of the document image data into an ICC profile suitable to the model name set in step S1.

Subsequently, the setting terminal sets an output value of the discharge electrodes (corresponding to the plasma energy amount) in the plasma processing (step S12). The setting of the plasma energy amount is performed by using, for example, a table illustrating a correspondence relationship between the size of droplet, the type of paper, and the plasma energy amount according to the size of droplet and the type of paper illustrated in FIG. 17. For example, the setting terminal holds the correspondence relationship table illustrated in FIG. 17 and automatically identifies a corresponding plasma energy amount based on the size of ink droplet set in step S6 and the type of paper set in step S3.

The print setting table as illustrated in FIG. 18 is created by following the creation procedure chart described above. It is possible to deliver the created print setting table to another printing apparatus (system) 1 through a recording medium such as, for example, a USB memory, an SD memory card, a CD, and a DVD and download the created print setting table to another printing apparatus (system) 1 through a communication line such as a public line, the Internet, and a LAN (Local Area Network). Alternatively, it is possible to install the created print setting table in the printing apparatus (system) 1 through a portable type electronic device such as a mobile phone, a smartphone, and a smart device.

Figure 19:
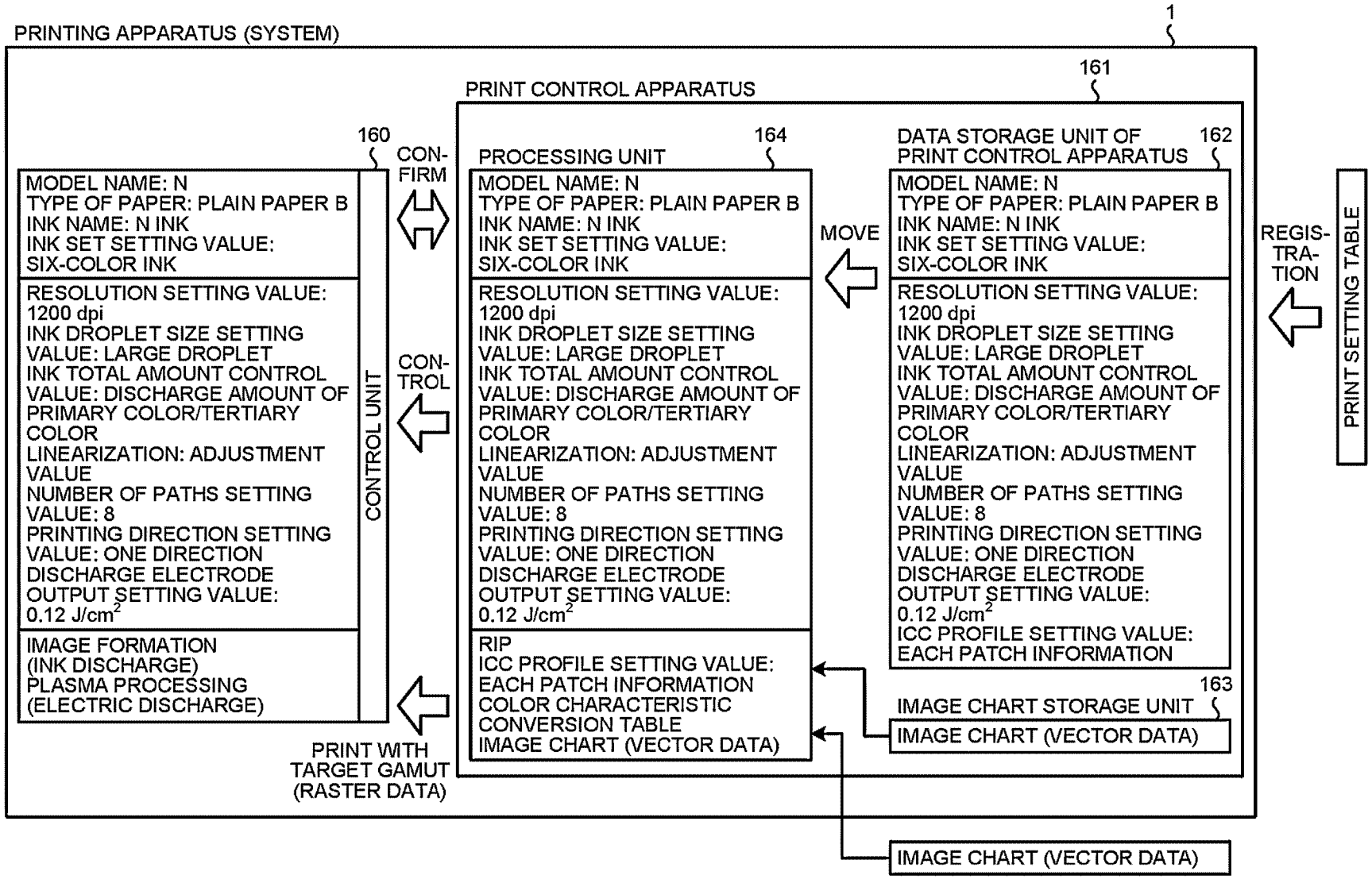
FIG. 19 is a diagram for explaining a flow of installing print setting data in a printing apparatus (system) 1 in which a print control apparatus according to the embodiment is mounted.
Figure 20:
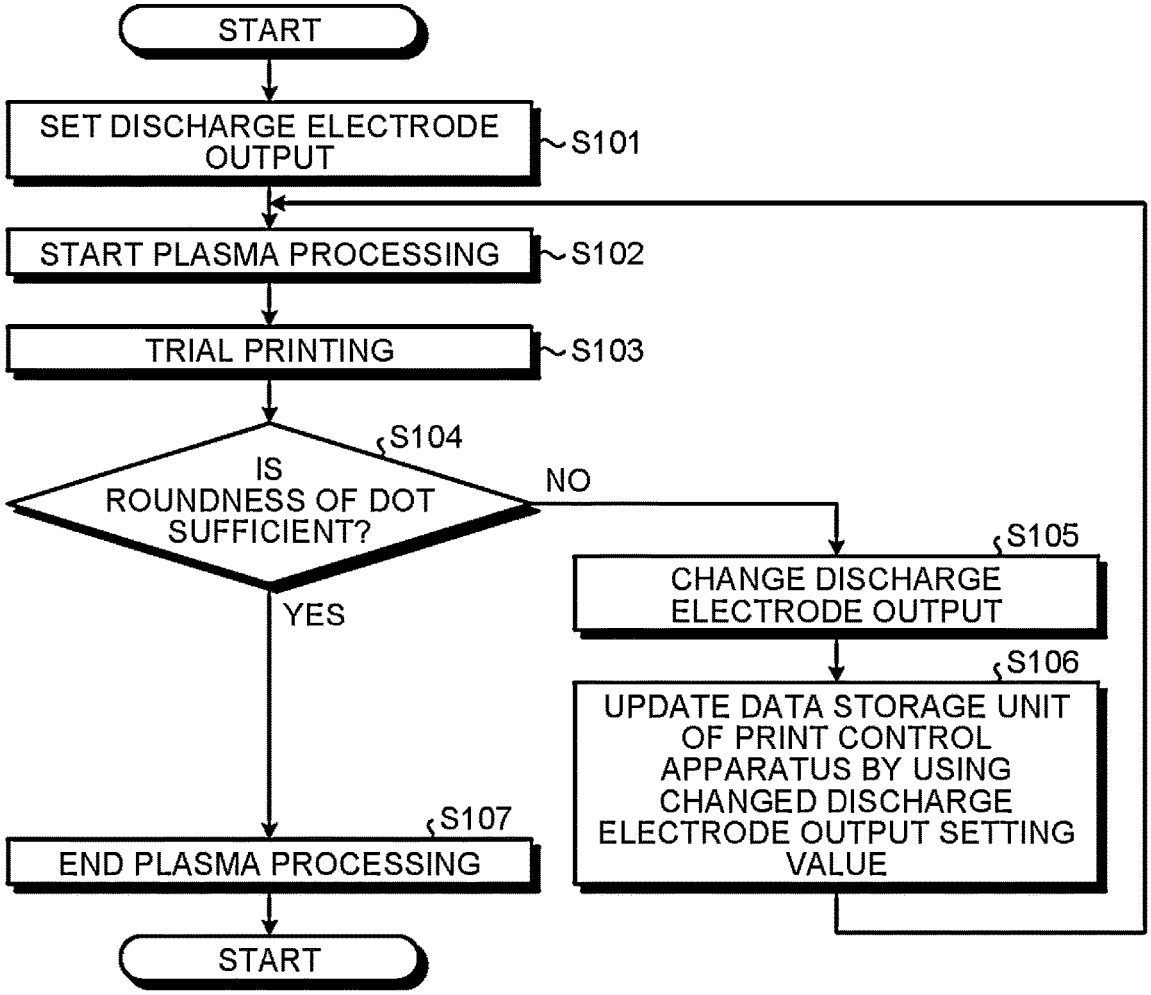
FIG. 20 is a flowchart illustrating an operation example from execution of trial printing to update of a discharge electrode output setting value according to the embodiment.

Next, an operation to install the print setting table created as described above in the printing apparatus (system) 1 will be described in detail with reference to the drawings. The created print setting table is registered in a memory or the like in the print control apparatus of the printing apparatus (system) 1 that actually prints the document image. FIGS. 19 and 20 are diagrams for explaining a flow of installing print setting data in the printing apparatus (system) 1 in which the print control apparatus according to the embodiment is mounted. However, in FIG. 19, the print control apparatus 161 need not be installed inside the printing apparatus (system) 1 and may be provided outside of the printing apparatus (system) 1 and connected through a network such as the Internet and a LAN.

First, as illustrated in FIG. 19, one or more print setting tables corresponding to the model name of the printing apparatus (system) 1 are registered in a print control apparatus 161. The registered print setting table is stored in a data storage unit 162 of the print control apparatus 161 and called by a processing unit 164 as needed. An image chart (vector data) to be printed is also inputted into the processing unit 164. The image chart (vector data) may be inputted from an image chart storage unit 163 of the print control apparatus 161 or may be inputted from outside.

The processing unit 164 of the print control apparatus 161 converts the inputted image chart (vector data) into document image data (raster data) used for actual printing. Here, a method of converting the image chart (vector data) into the document image data (raster data) will be described. Data (vector data) of an application created by a PC or the like is created with a format that cannot be understood by the printing apparatus (system) 1, so that the data (vector data) has to be converted into data (raster data) that can be understood by the printing apparatus (system) 1. This processing is performed by a RIP (Raster Image Processor) in the processing unit 164. Here, while the vector data is data represented by smooth curved lines, the raster data is data represented by an aggregate of dots, so that when the raster data is enlarged, jaggy occurs at a contour portion. On the other hand, the raster data has characteristics of being suited to delicate color representation such as a photographic image. Therefore, the RIP generates raster data according to the resolution of the printing apparatus (system) 1 from the vector data. Further, the RIP also performs processing to convert color information (for example, RGB) of the document image data into color information (for example, CMYK) corresponding to the printing apparatus (system) 1.

Subsequently, the user calls a print setting table having a printing condition (print mode) suitable for the processing object 20 from a plurality of print setting tables registered in the data storage unit 162. Thereby, the called print setting table moves to the processing unit 164. On the other hand, the control unit 160 of the printing apparatus (system) also holds a print setting table. The processing unit 164 of the print control apparatus 161 and the control unit 160 of the printing apparatus (system) 1 exchange information of the model name and the ink set setting value in the print setting table held by each unit, and confirm that there is no disagreement in condition in the information. It is possible to exchange information of the type of paper and the ink name besides the model name and the ink set to determine whether or not there is disagreement in condition.

When it is confirmed that there is no disagreement in condition, the control unit 160 performs trial printing by using setting values of the resolution, the size of ink droplet, the ink total amount control, the linearization, the number of paths, the printing direction, and the discharge electrode output which are registered in the print setting table. In this case, a mixture ratio of each color ink is determined so that a target gamut (for example, gamut of Japan Color) can be secured by using the setting value of the ICC profile and a color characteristic conversion table. Thereafter, the control unit 160 plasma-processes the processing object 20 with the set discharge electrode output setting value (the plasma energy amount) and performs trial printing of document image data, which is raster data converted from the image chart (vector data) by the RIP, on the plasma-processed processing object 20. When the control unit 160 of the printing apparatus (system) has no print setting table, the print setting table read from the data storage unit 162 may be transmitted to the control unit 160.

Subsequently, the control unit 160 checks an image formed by the trial printing and evaluates the quality of the image. An operation from execution of the trial printing to update of the discharge electrode output setting value will be described with reference to FIG. 20. FIG. 20 illustrates an operation of the control unit 160. FIG. 20 illustrates a case where the circularity of ink dot is used as an index for evaluating the quality of the image. However it is not limited to this.

As illustrated in FIG. 20, first, the control unit 160 reads the discharge electrode output (the plasma energy: 0.12 J/cm$^2$) for trial printing and sets the discharge electrode output in the plasma processing apparatus 100 (step S101). Subsequently, the plasma processing is started in the plasma processing apparatus 100 (step S102) and then the document image data is printed as a trial by the image forming apparatus 40 (step S103).

Subsequently, the control unit 160 reads the document image printed as a trial by using the pattern reading unit 180 and determines whether or not the circularity of a dot is sufficient by analyzing the dot in the obtained image (step S104). When the circularity of the dot is not sufficient (step S104; NO), the control unit 160 recalculates the discharge electrode output setting value (the plasma energy amount) so that the discharge electrode output (the plasma energy amount) becomes optimal and changes the discharge electrode output setting value (the plasma energy amount) to the recalculated setting value (for example; the plasma energy: 0.14 J/cm$^2$) (step S105). The recalculation of the discharge electrode output setting value (the plasma energy amount) can be implemented by various methods such as, for example, a method in which a predetermined adjustment value is added to or subtracted from the current setting value and a method in which an adjustment value calculated according to deviation from a target value of the circularity is added to or subtracted from the current setting value.

When the control unit 160 recalculates the discharge electrode output setting value (the plasma energy amount) in this way, the control unit 160 notifies the print control apparatus 161 of the changed discharge electrode output setting value (the changed plasma energy amount) and updates a corresponding discharge electrode output setting value (the plasma energy amount) in the print setting table stored in the data storage unit 162 by replacing the corresponding discharge electrode output setting value with the changed discharge electrode output setting value (step S106), and thereafter returns to step S102. The control unit 160 also updates the discharge electrode output setting value (the plasma energy amount) in the print setting table held by the control unit 160 to the changed value.

On the other hand, when the circularity of the dot is sufficient (step S104; YES), the control unit 160 ends the plasma processing (step S107) and ends the operation. Thereby, the discharge electrode output setting value (the plasma energy amount) registered in the print setting table is updated to an optimal value.

In the above description, a case is described where the discharge electrode output setting value (the plasma energy amount) is registered in the print setting table. It is not limited to this. For example, instead of the plasma energy amount, the frequency and/or the voltage value of the pulse voltage supplied from each of the high frequency high voltage power supplies 151 to 156 and the number of high frequency high voltage power supplies 151 to 156 to be driven (that is, the number of discharge electrodes to which the pulse voltage is applied) may be registered.

Figure 21:
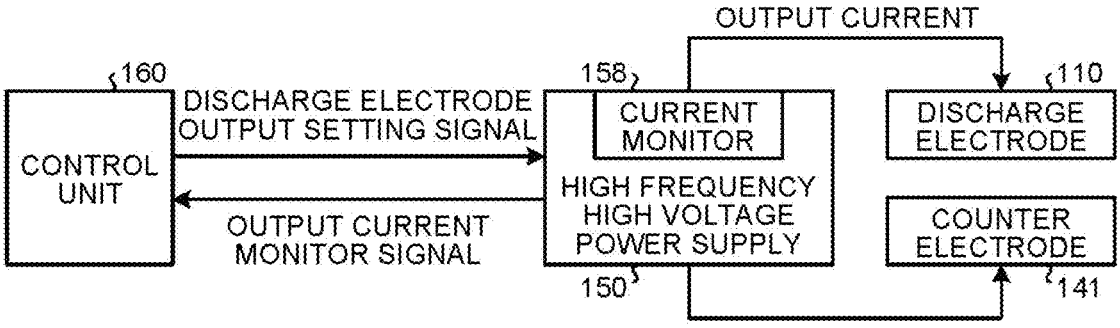
FIG. 21 is a schematic diagram illustrating a configuration for measuring an output of discharge electrode according to the embodiment.

It is also possible to configure so that the output of the discharge electrode is measured in the plasma processing apparatus 100. FIG. 21 is a schematic diagram illustrating a configuration for measuring the output of the discharge electrode. For the sake of simplicity, FIG. 21 illustrates a case where there is one discharge electrode.

In the configuration illustrated in FIG. 21, the high frequency high voltage power supply 150 includes a current monitor 158 for measuring an output current flowing to the discharge electrode 110. When a plurality of high frequency high voltage power supplies 151 to 156 and a plurality of discharge electrodes 111 to 116 are included in the configuration, the current monitor may be provided to each of the high frequency high voltage power supplies 151 to 156. The control unit 160 outputs a discharge electrode output setting signal for flowing current to the discharge electrode 110 to the high frequency high voltage power supply 150 having, for example, the current monitor 158 of low current control type according to the discharge electrode output setting value in the print setting table. The high frequency high voltage power supply 150 applies a pulse voltage to the discharge electrode 110 according to the inputted discharge electrode output setting signal. The current monitor 158 measures an output current at that time and transmits the measurement value or an integrated value (electric energy) of the measurement value to the control unit 160 as an output current monitor signal. The control unit 160 that receives the output current monitor signal may display the value of the output current monitor signal on a display not illustrated in the drawings or transmit the value to a terminal such as a smartphone and a smart device carried by a user. Thereby, it is possible to notify the user in substantially real-time of the power consumption of the plasma processing apparatus 100 and to take the statistics of the power consumption of each time zone. Further, it is also possible to identify an optimal current waveform by measuring the waveform of the output current. As a result of these, it is possible to reduce energy consumption required for the print processing.

Figure 22:
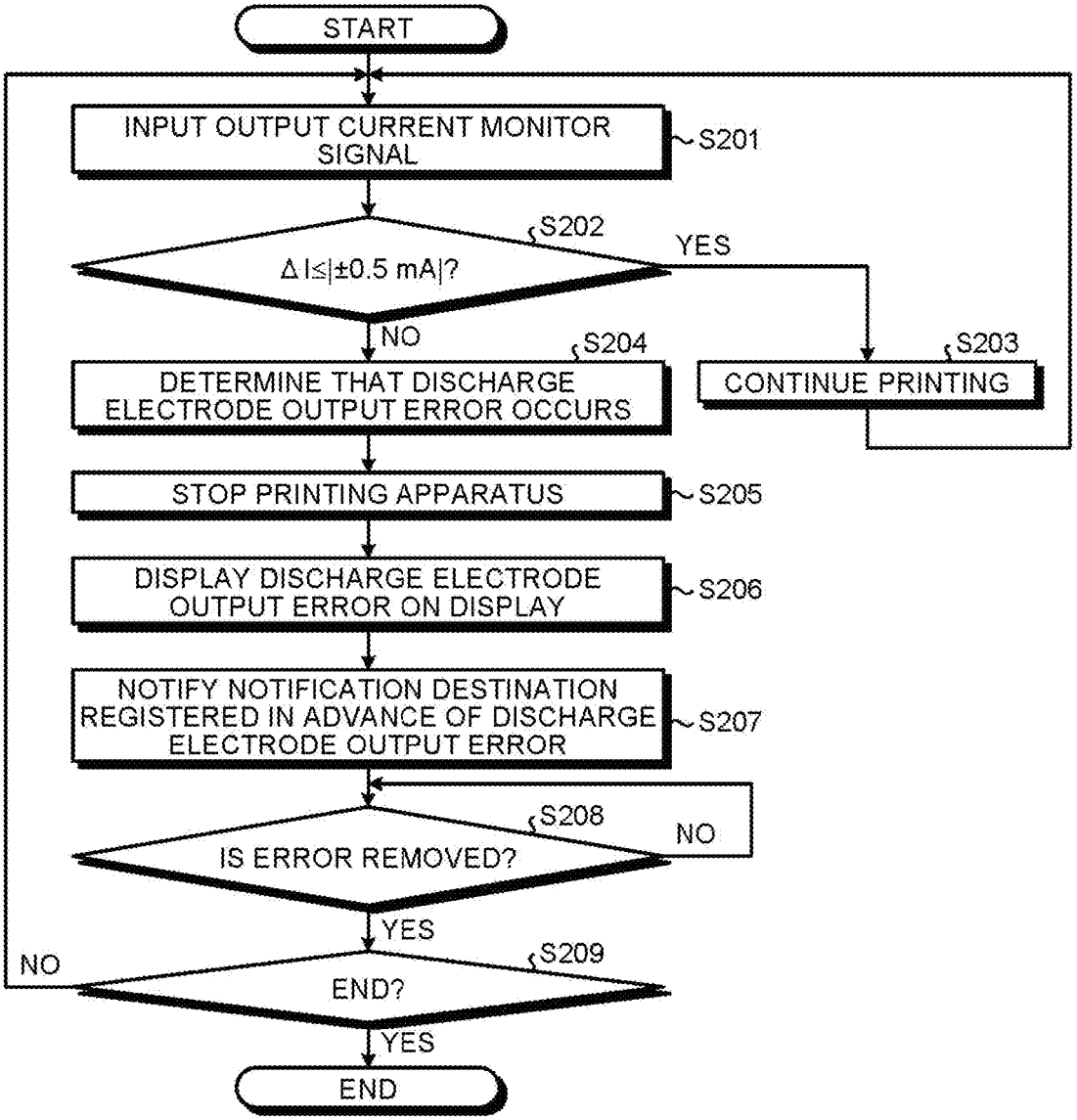
FIG. 22 is a flowchart illustrating an operation example when abnormal output of discharge electrode is detected based on the output of discharge electrode according to the embodiment.

Further, it is also possible to detect a device failure such as anomalous discharge by measuring an output of the discharge electrode. FIG. 22 is a flowchart illustrating an operation example when an abnormal output of the discharge electrode is detected based on the output of the discharge electrode.

As illustrated in FIG. 22, when the output current monitor signal is inputted into the control unit 160 (step S201), the control unit 160 calculates a difference ΔI between a current value indicated by the output current monitor signal and a predetermined current value in normal operation and determines whether or not the difference ΔI is within a predetermined allowable range (smaller than or equal to ±0.5 mA) (step S202). When the difference ΔI is within the allowable range (smaller than or equal to ±0.5 mA) (step S202; YES), the control unit 160 determines to continue the print processing including the plasma processing (step S203) and returns to step S201.

On the other hand, when the difference ΔI is outside the allowable range (step S202; NO), the control unit 160 determines that an output error occurs in the discharge electrode 110 (step S204) and stops the printing apparatus (system) 1 (in particular, the plasma processing apparatus 100) (step S205). Subsequently, the control unit 160 displays that an output error of the discharge electrode occurs on a display not illustrated in the drawings (step S206) and transmits that an output error of the discharge electrode occurs to a notification destination (for example, e-mail address) registered in advance (step S207). Thereafter, the control unit 160 stands by until the error is removed (step S208; NO). When the error is removed (step S208; YES), the control unit 160 determines whether or not to end the operation (step S209), and when determining not to end the operation (step S209; NO), the control unit 160 returns to step S201. On the other hand, when determining to end the operation (step S209; YES), the control unit 160 ends the operation.

As described above, a device failure such as abnormal discharge is notified to the user, so that it is possible to detect and remove a failure in an early stage. Thereby, the productivity can be further improved. In FIG. 22, an abnormal output of the discharge electrode 110 is detected based on the current value of the output current. However, it is not limited to this. For example, the abnormal output of the discharge electrode 110 may be detected based on the current waveform of the output current.

Figure 23:
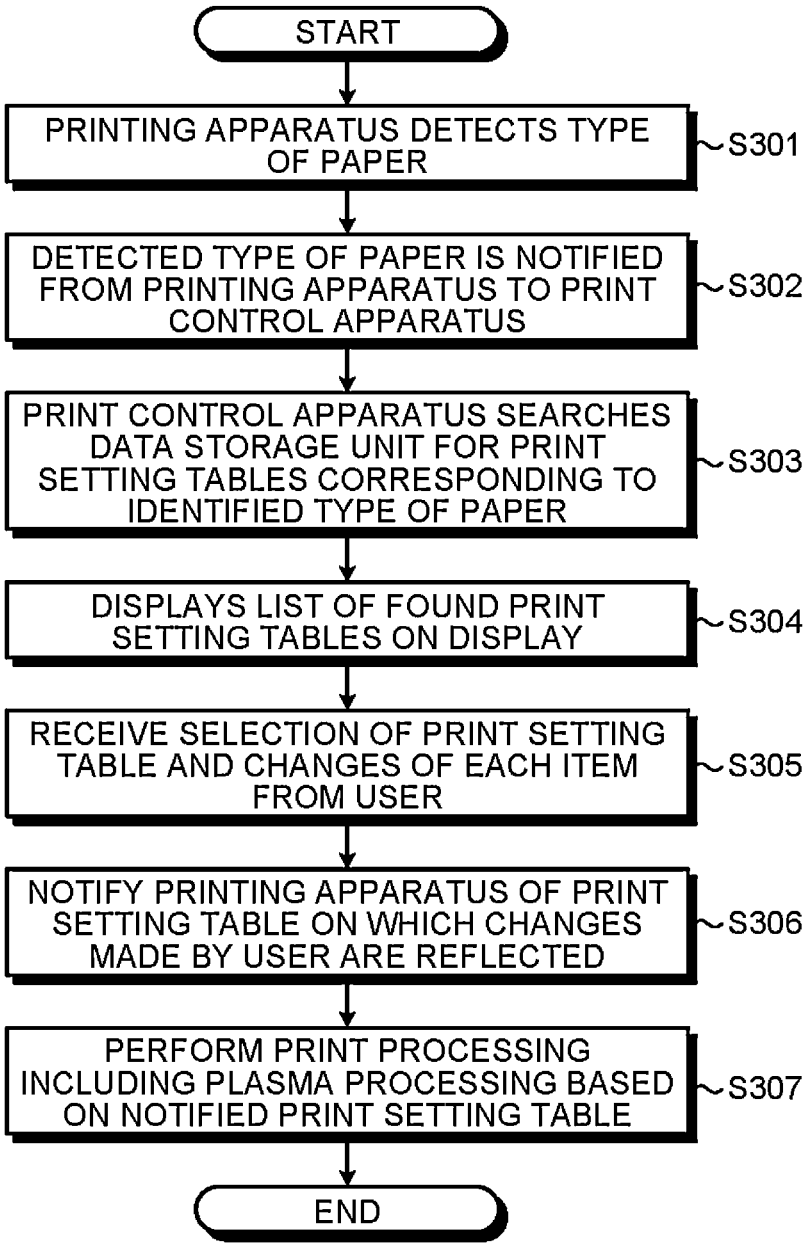
FIG. 23 is a flowchart illustrating a printing operation example including a flow of calling a print setting table used according to a type of paper of a processing object according to the embodiment.

Further, in the embodiment, it is possible to configure to detect the type of paper of the processing object 20 set in the printing apparatus (system) 1, detect a print setting table to be used according to the detected type of paper, and call the print setting table to be used according to the detected type of paper. FIG. 23 illustrates a flow of the printing operation in this case.

As illustrated in FIG. 23, in the operation, first, a processing object detection unit mounted in the printing apparatus (system) 1 identifies the type of paper of the set processing object 20 (step S301). The processing object detection unit may be a mechanism that detects the type of paper by irradiating the surface of the processing object 20 with a laser beam and analyzing an interference spectrum of reflected light of the laser beam, a mechanism that detects the type of paper by reading a barcode printed on a packaging box of the processing object 20 by a reader, and the like.

The detected type of paper of the processing object 20 is notified from the control unit 160 of the printing apparatus (system) 1 to the print control apparatus 161 (step S302). In response, the print control apparatus 161 searches the data storage unit 162 for all print setting tables corresponding to the identified type of paper of the processing object 20 and identifies the print setting tables (step S303), and then displays a list of the identified print setting tables on a display (step S304). Subsequently, the print control apparatus 161 receives a selection of a print setting table selected from the displayed list and changes of each item in the selected print setting table from a user (step S305).

Thereafter, the print control apparatus 161 notifies the control unit 160 of the printing apparatus (system) 1 of a print setting table on which the changes made by the user are reflected (step S306). In response, the printing apparatus (system) 1 performs print processing including the plasma processing based on the notified print setting table (step s307) and ends the operation immediately after the completion of the print processing.

By configuring as described above, the user can select a desired print condition from the print setting table displayed on a screen and perform the print processing including the plasma processing after appropriately changing the print condition, so that the productivity can be further improved.

In FIG. 23, the selection of the print setting table and the changes of each item (step S305) are performed by using the display and an input unit (which are not illustrated in the drawings) of the print control apparatus 161. However, it is not limited to this. For example, the list of the print setting tables found in step S304 may be displayed on a terminal such as a smartphone and a smart device registered in advance and a user's input corresponding to the list may be received from the terminal.

In the creation procedure and the installation procedure of the print setting table described with reference to FIGS. 15 to 19 in the above description, an initial plasma energy amount is determined by using the table illustrated in FIG. 17. However, it is not limited to this method. For example, the first plasma energy amount is set to a minimum value and the plasma energy amount may be gradually increased based on an analysis result of the obtained dot image of test pattern.

Figure 24:
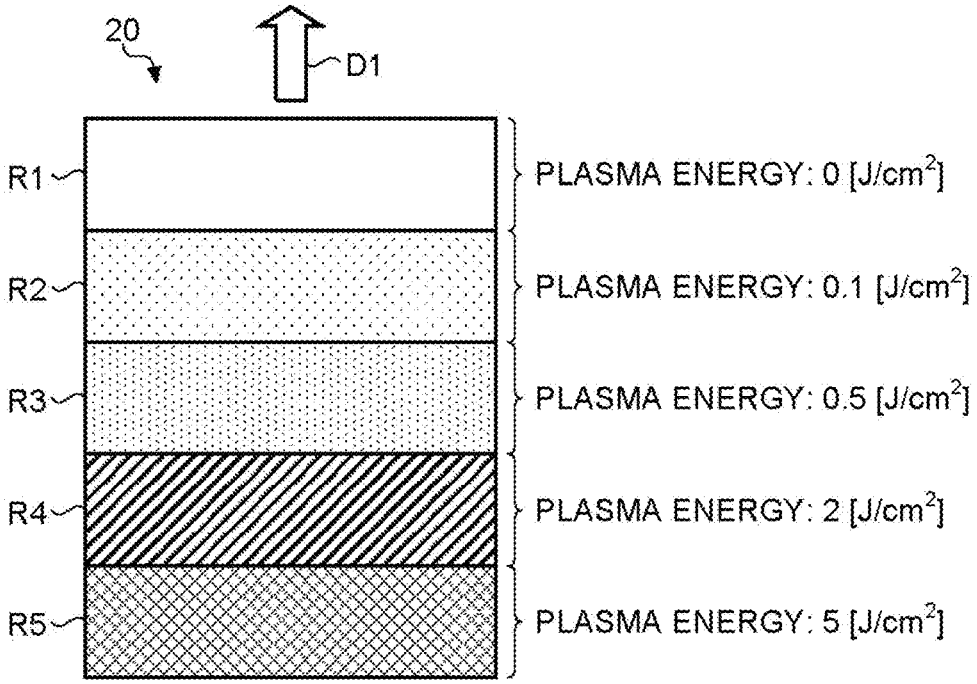
FIG. 24 is a diagram illustrating an example of a processing object which is plasma-processed by using a different plasma energy for each region in the embodiment.

When the plasma energy amount is gradually increased from the minimum value, the plasma energy amount applied to each of the discharge electrodes 111 to 116 in FIG. 14 may be changed to be gradually increased from the downstream side or the conveyance speed of the processing object 20, that is, the circulation speed of the dielectric 121, may be changed. As a result, in the trial printing described with reference to FIG. 19, as illustrated in FIG. 24, it is possible to obtain the processing object 20 in which each region is plasma-processed with a different plasma energy amount. In FIG. 24, the region R1 is a region that is not plasma-processed (the plasma energy=0 J/cm$^2$), the region R2 indicates a region that is plasma-processed with a plasma energy of 0.1 J/cm$^2$, the region R3 indicates a region that is plasma-processed with a plasma energy of 0.5 J/cm$^2$, the region R4 indicates a region that is plasma-processed with a plasma energy of 2 J/cm$^2$, and the region R5 indicates a region that is plasma-processed with a plasma energy of 5 J/cm$^2$.

Figure 25:
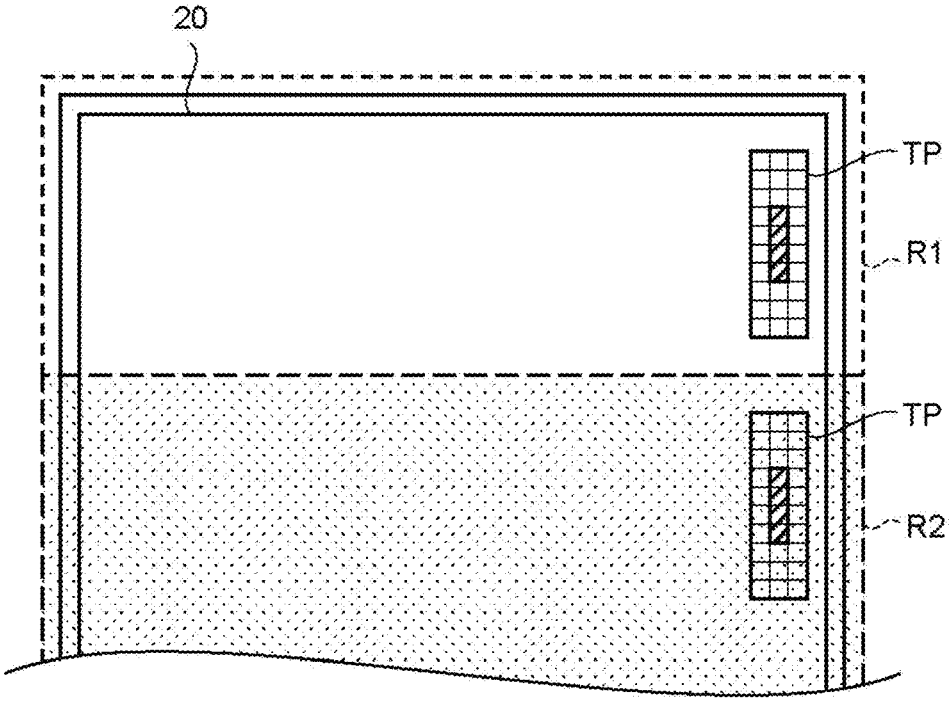
FIG. 25 is a diagram illustrating an example of a test pattern formed for the processing object illustrated in FIG. 24.

On the processing object 20 in which each region is plasma-processed with a different plasma energy amount as illustrated in FIG. 24, a common test pattern TP including a plurality of dots having different dot diameters as illustrated in FIG. 25 may be formed in each of the regions R1 to R5.

Figure 26:
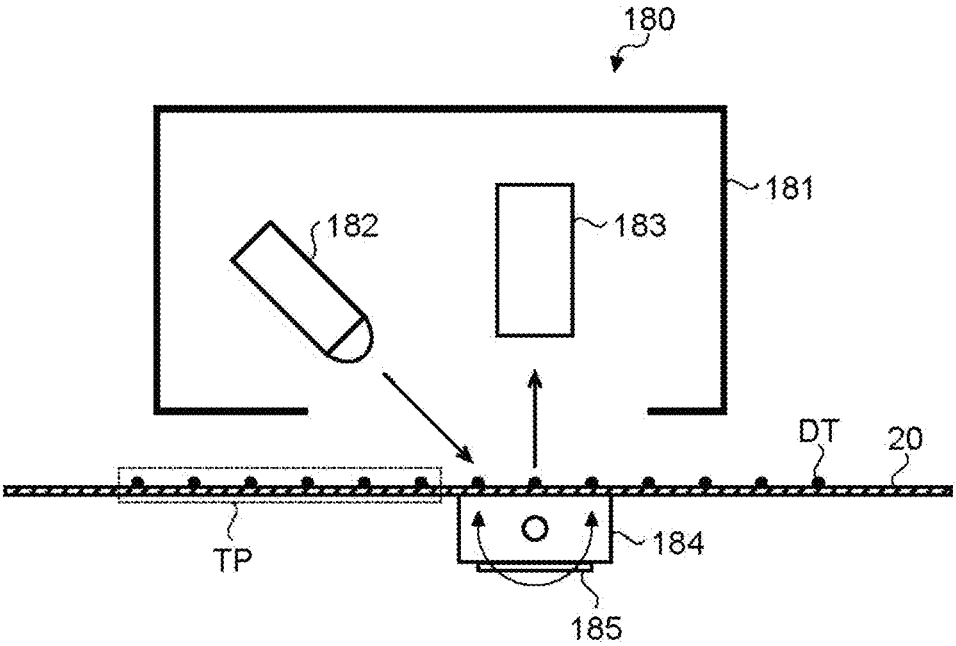
FIG. 26 is a schematic diagram illustrating an example of the pattern reading unit according to the embodiment.

The test pattern TP formed as described above is read by the pattern reading unit 180 in FIG. 14. FIG. 26 is illustrates an example of the pattern reading unit 180 according to the embodiment.

As illustrated in FIG. 26, for example, a reflection type two-dimensional sensor including a light emitting unit 182 and a light receiving unit 183 is used as the pattern reading unit 180. The light emitting unit 182 and the light receiving unit 183 are arranged in a housing 181 arranged on a dot forming side of the processing object 20. An opening portion is provided in a side of the housing 181 facing the processing object 20 and light emitted from the light emitting unit 182 is reflected by the surface of the processing object 20 and enters the light receiving unit 183. The light receiving unit 183 forms an image of reflected light amount (reflected light intensity) reflected by the surface of the processing object 20. The light amount (intensity) of the reflected light formed into an image varies between a portion including printing (dot DT of the test pattern TP) and a portion including no printing, so that it is possible to detect the shape of the dot and the image density in the dot on the basis of the reflected light amount (reflected light intensity) detected by the light receiving unit 183. The configuration of the pattern reading unit 180 and the detection method of the pattern reading unit 180 can be variously changed as long as the pattern reading unit 180 can detect the test pattern TP printed on the processing object 20.

The pattern reading unit 180 may include a reference pattern display unit 184 including a reference pattern 185 as a means of calibrating a light amount of the light emitting unit 182 and a reading voltage of the light receiving unit 183. The reference pattern display unit 184 has a rectangular parallelepiped shape formed by, for example, a predetermined processing object (for example, plain paper) and the reference pattern 185 is attached to one surface of the rectangular parallelepiped. When the calibration of the light emitting unit 182 and the light receiving unit 183 is performed, the reference pattern display unit 184 rotates so that the reference pattern 185 faces the light emitting unit 182 and the light receiving unit 183, and when the calibration is not performed, the reference pattern display unit 184 rotates so that the reference pattern 185 does not face the light emitting unit 182 and the light receiving unit 183. The reference pattern 185 may have, for example, the same shape as that of the test pattern TP illustrated in FIG. 25.

In the embodiment, a case is illustrated where the plasma energy amount is adjusted based on the analysis result of the dot image acquired by using the pattern reading unit 180. However, it is not limited to this. For example, it may be configured so that a user may set the plasma energy amount based on the test pattern TP formed on the plasma-processed processing object 20.

Figure 27:
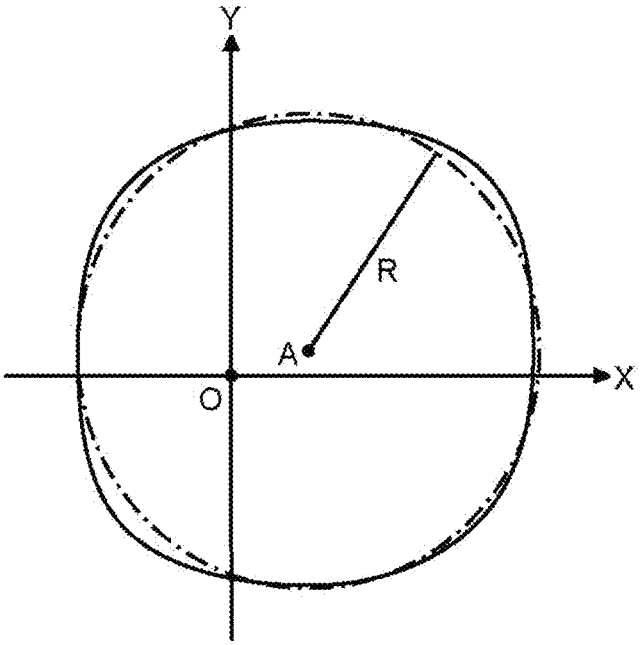
FIG. 27 is a diagram illustrating an example of a captured image of a dot (a dot image) acquired in the embodiment.

Next, an example of a determination method of the size of dot in the test pattern formed on the processing object 20 will be described with reference to the drawings. To determine the size of dot in the test pattern, the test pattern TP as illustrated in FIG. 25 is recorded on the plasma-processed processing object 20 and images of the test pattern TP and the reference pattern 185 are captured by the pattern reading unit 180, so that a captured image of a dot (a dot image) as illustrated in FIG. 27 is acquired. It is assumed that the position of the reference pattern 185 in the entire image capturing area of the light receiving unit 183 illustrated in FIG. 26 (the entire image capturing area of the two-dimensional sensor) is known in advance by measurement. The control unit 160 performs calibration for the dot image of the test pattern TP by comparing a pixel of the dot image of the acquired test pattern TP and a pixel of the dot image of the reference pattern 185. In this case, for example, as illustrated in FIG. 27, there is a circle-like figure, which is not a perfect circle, (for example, a contour portion (solid line) of a dot of the test pattern TP) and the circle-like figure is fitted by a true circle (a contour portion (dot and dash line) of a dot of the reference pattern 185). In this fitting, a least-squares method is used.

Figure 28:
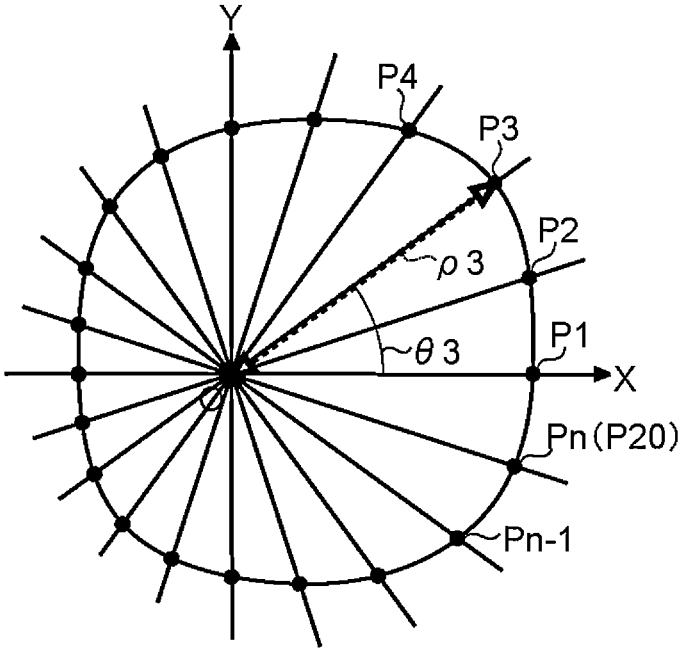
FIG. 28 is a diagram for explaining a flow of applying a least square method to the captured image illustrated in FIG. 27.

As illustrated in FIG. 28, in the least-squares method, to calculate a deviation between the circle-like figure (solid line) and the true circle (dot and dash line), an origin O is defined at a roughly center position, an XY coordinate system based on the origin O is set, and finally an optimal center point A (coordinates (a, b)) and the radius R of the true circle are obtained. Therefore, first, the circumference ($2\pi$) of the circle-like figure is uniformly divided based on an angle and then for each of data points P1 to Pn obtained by the division, an angle $\theta i$ with respect to the X axis and a distance $\rho i$ from the origin O are obtained. Here, when the number of the data points (that is, the number of data sets)

is "N", the following formula (1) can be derived from a relation of trigonometric function.

$$x_i=\rho_i \cos \theta_i$$

$$y_i=\rho_i \sin \theta_i \quad (1)$$

At this time, the optimal center point A (coordinates (a, b)) and the radius R of the true circle are given by the following formula (2).

$$R = \frac{\sum_{i=1}^{N} \rho_i}{N} \quad (2)$$

$$a = \frac{2\sum_{i=1}^{N} x_i}{N}$$

$$b = \frac{2\sum_{i=1}^{N} y_i}{N}$$

In this way, the dot image of the reference pattern 185 is read and the calibration is performed by comparing the diameter of the dot calculated by the aforementioned least-squares method with the diameter of the reference chart. After the calibration, the dot image printed in a pattern is read and the diameter of the dot is calculated.

In general, the circularity is represented by a difference between the radiuses of two concentric geometric circles when the circle-like figure is sandwiched by the two concentric circles and a distance between the concentric circles becomes minimum. However, the ratio of minimum diameter/maximum diameter of the concentric circles can be defined as the circularity. In this case, when the value of minimum diameter/maximum diameter is "1", it means that the circle-like figure is a true circle. This circularity can also be calculated by the least-squares method by obtaining the dot image.

The maximum diameter can be obtained as a maximum distance of distances between a dot center of the obtained image and each point on the circumference of the dot. On the other hand, the minimum diameter can be calculated as a minimum distance of distances between the dot center and each point on the circumference of the dot.

The dot diameter and the circularity of the dot vary depending on the color or the type of used ink and a permeation state of the ink into the processing object 20. In the embodiment, the quality of image is improved by controlling the dot shape (the circularity) and the dot diameter to be targeted values according to the color or the type of used ink, the type of the processing object 20, and the discharge amount of ink. Further, in the embodiment, a high quality image is achieved by adjusting the plasma energy amount in the plasma processing so that the dot diameter per amount of ink discharge becomes a target dot diameter by reading a formed image and analyzing the image.

In the embodiment, it is possible to detect the pigment density in a dot based on the light amount of the reflected light, so that an image of a dot is taken and the density in the dot is measured. The density unevenness is measured by calculating the density values as variation distribution by statistical calculation. Further, it is possible to prevent the mixture of pigment due to merge of dots by selecting the plasma energy amount so as to minimize the calculated density unevenness, and thereby it is possible to achieve a higher quality image. Regarding whether to give priority to the control of the dot diameter, the suppression of the density unevenness, or the improvement of the circularity, it is possible to configure so that a user can switch modes according to a desired image quality.

As described above, in the embodiment, the plasma energy amount is controlled according to the color or the type of the ink so that the unevenness of the circularity of dot or the unevenness of pigment in a dot is reduced or the dot diameter becomes a target size. Thereby, it is possible to provide high quality printed matter while realizing homogenization of dot diameters and saving energy. Even when the characteristics of the processing object 20 is changed or the printing speed is changed, it is possible to perform stable plasma processing, so that it is possible to stably realize good image recording.

In the embodiment described above, a case is described where the plasma processing is mainly performed on the processing object. As described above, when the plasma processing is performed, the wettability of ink with respect to the processing object is improved. As a result, a dot to be attached during ink jet recording spreads, so that an image different from an image printed on an unprocessed processing object may be recorded. Therefore, when printing on a plasma-processed recording medium, it is possible to perform the printing by, for example, reducing the size of ink droplet by lowering the discharge voltage of ink when performing the ink jet recording. As a result, the size of ink droplet can be reduced, so that cost down can be achieved.

Figure 29:
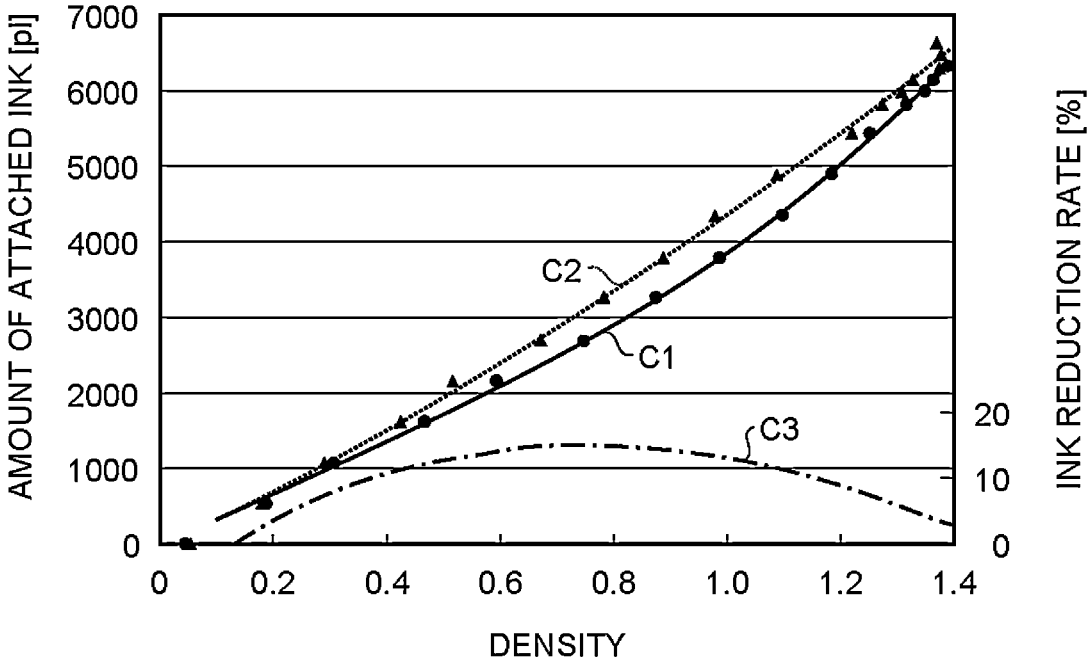
FIG. 29 is a graph illustrating a relationship between an ink discharge amount and an image density according to the embodiment.

FIG. 29 is a graph illustrating a relationship between the ink discharge amount and the image density according to the embodiment. In FIG. 29, the solid line C1 indicates a relationship between the ink discharge amount and the image density when the plasma processing according to the embodiment is performed and the dashed line C2 indicates a relationship between the ink discharge amount and the image density when the ink jet recording processing is performed on the processing object 20 to which the plasma processing according to the embodiment is not applied. Further, the dot and dash line C3 indicates an ink reduction rate of the solid line C1 with respect to the dashed line C2.

As known from the comparison between the solid line C1 and the dashed line C2 in FIG. 29 and the dot and dash line C3, when the plasma processing according to the embodiment described above is applied to the processing object 20 before the ink jet recording processing, the ink discharge amount required to obtain the same image density is reduced by the effects such as the improvement of the circularity of dot, the enlargement of dot, and the homogenization of the pigment density in a dot.

Further, when the plasma processing according to the embodiment described above is applied to the processing object 20 before the ink jet recording processing, the thickness of the pigment attached to the processing object 20 is reduced, so that it is possible to obtain the effects of improvement of chroma and enlargement of color gamut. Further, as a result of reduction of the amount of ink, the energy for drying the ink can also be reduced, so that it is possible to obtain a power saving effect.

According to the present embodiments, it is possible to provide a processing object reforming apparatus, a printing apparatus, a processing object reforming system, a printing system, a manufacturing method of printed matter, and a program, which can reform a surface of a processing object so as to be able to manufacture high-quality printed matter.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A processing object reforming apparatus comprising:

a plasma processing unit that acidifies at least a surface of a processing object comprising paper or film, the processing object having a polymer upon its surface, by processing the surface of the processing object by using plasma, causing a chemical reaction between polymers, disposed at the surface, and the plasma; and a control unit that controls the plasma processing unit to plasma-process the processing object with a plasma energy amount based on a type of material that is included at the surface of the processing object;

wherein the plasma processing unit comprises at least one discharge electrode that generates the plasma, and the control unit controls the plasma processing unit to plasma-process the processing object with the plasma energy amount by adjusting a voltage value of a voltage pulse to be applied to the at least one discharge electrode or adjusting the number of the discharge electrodes to which the voltage pulse is to be applied.

2. The processing object reforming apparatus according to claim 1, further comprising:

a measurement unit that measures an output of the plasma processing unit; and a display unit that displays a measurement result measured by the measurement unit.

3. The processing object reforming apparatus according to claim 2, wherein the display unit displays an integrated value of the measurement result measured by the measurement unit.

4. The processing object reforming apparatus according to claim 2, further comprising:

a transmitting unit that transmits the measurement result measured by the measurement unit to a communication terminal through a communication line.

5. The processing object reforming apparatus according to claim 2, wherein the control unit determines whether an abnormality occurs in the plasma processing unit on the basis of the measurement result measured by the measurement unit.

6. The processing object reforming apparatus according to claim 5, wherein the control unit stops the plasma processing of the plasma processing unit when determining that the abnormality occurs in the plasma processing unit on the basis of the measurement result measured by the measurement unit.

7. The processing object reforming apparatus according to claim 1, further comprising:

the processing object, wherein the processing object includes surface polymers.

8. The processing object reforming apparatus according to claim 1, further comprising:

a data storage unit that stores at least one of a plasma energy amount which the plasma processing unit uses to generate the plasma, a voltage value of a voltage pulse to be applied to one or more discharge electrodes included in the plasma processing unit, and the number of discharge electrodes to which the voltage pulse is to be applied among the one or more discharge electrodes, in association with a type of the processing object, wherein the control unit identifies at least one of the plasma energy amount to be used, the voltage value of the voltage pulse to be applied, and the number of discharge electrodes to which the voltage pulse is to be applied from the data storage unit on the basis of the type of the processing object and controls the plasma processing unit to plasma-process the processing object with the plasma energy amount based on the type of the processing object by controlling the plasma processing unit on the basis of at least one of the identified plasma energy amount to be used, the identified voltage value of the voltage pulse to be applied, and the identified number of discharge electrodes to which the voltage pulse is to be applied.

9. A printing apparatus comprising:

the processing object reforming apparatus according to claim 1; and a recording unit that performs ink jet recording on the surface of the processing object, which has been plasma-processed by the plasma processing unit.

10. The printing apparatus according to claim 9, further comprising:

a reading unit that reads an image which is formed on the surface of the processing object by the recording unit; and an evaluation unit that evaluates the image read by the reading unit, wherein the control unit updates the plasma energy amount on the basis of an evaluation result by the evaluation unit, the plasma energy amount used to generate the plasma by the plasma processing unit.

11. The printing apparatus according to claim 9, wherein the control unit controls the plasma processing unit to plasma-process the processing object with the plasma energy amount based on at least one of a model name of the printing apparatus, an ink name, the number of colors of ink set, a resolution, a size of ink droplet, the number of paths, a printing direction, an ink total amount control value, and an ICC profile in addition to the type of the processing unit.

12. The printing apparatus according to claim 9, further comprising:

an identification unit that identifies the type of the processing object, wherein the control unit controls the plasma processing unit to plasma-process the processing object with the plasma energy amount based on the type of the processing object identified by the identification unit.

13. The printing apparatus according to claim 12, further comprising:

a storage unit that stores one or more setting tables which associate the type of the processing objet with at least one of the plasma energy amount which is used to generate the plasma by the plasma processing unit, a voltage value of a voltage pulse to be applied to one or more discharge electrodes included in the plasma processing unit, and the number of discharge electrodes to which the voltage pulse is to be applied among the one or more discharge electrodes;

a display unit that displays a list of the setting tables; and a selection unit that causes a user to select any one of the setting tables from the list of the setting tables displayed by the display unit, wherein the control unit identifies one or more setting tables corresponding to the type of the processing object from among the one or more setting tables stored in the storage unit, the display unit displays a list of the one or more setting tables identified by the control unit, and the control unit controls the plasma processing unit on the basis of the setting table selected by the selection unit.

14. The printing apparatus according to claim 13, further comprising:

a transmitting unit that transmits the list of the setting tables identified by the control unit to a communication terminal through a communication line; and a receiving unit that receives a setting table selected by using the communication terminal from the list of the identified setting tables, wherein the control unit controls the plasma processing unit on the basis of the setting table received by the receiving unit.

15. The printing apparatus according to claim 9, wherein an ink used by the recording unit is an ink in which negatively charged pigment is dispersed in a liquid.

16. The printing apparatus according to claim 9, wherein an ink used by the recording unit is an aqueous pigment ink.

17. A manufacturing method of printed matter according to the apparatus of claim 1, which is to manufacture printed matter where an image is formed on a processing object by an ink jet recording method, the manufacturing method comprising:

identifying a type of a processing object to be processed;

plasma-processing the processing object with a plasma energy amount based on the identified type of the processing object; and performing ink jet recording on a surface of the processing object which has been plasma-processed.

18. The apparatus of claim 1 wherein:

the processing object comprises paper; and types of the processing object comprise distinguishable kinds of paper.

19. A processing object reforming system comprising:

a plasma processing apparatus that acidifies at least a surface of a processing object comprising paper or film, the processing object having a polymer upon its surface, by processing the surface of the processing object by using plasma, causing a chemical reaction between polymers, disposed at the surface, and the plasma; and a control apparatus that controls the plasma processing apparatus to plasma-process the processing object with a plasma energy amount based on a type of material that is included at the surface of the processing object;

wherein the plasma processing unit comprises at least one discharge electrode that generates the plasma, and the control unit controls the plasma processing unit to plasma-process the processing object with the plasma energy amount by adjusting a voltage value of a voltage pulse to be applied to the at least one discharge electrode or adjusting the number of the discharge electrodes to which the voltage pulse is to be applied.

20. A printing system comprising:

the processing object reforming system according to claim 19; and a recording apparatus that performs ink jet recording on the surface of the processing object, the surface that has been plasma-processed by the plasma processing apparatus.

* * * * *